US005607159A

United States Patent [19]

Bryson

[11] Patent Number: 5,607,159

[45] Date of Patent: Mar. 4, 1997

[54] BOARD GAME HAVING A RANDOM INDICATOR FOR DETERMINING DIRECTION, AMOUNT AND AXIS OF REFERENCE OF MOVEMENT OF TOKENS

[76] Inventor: Paul H. Bryson, 41 Stalybridge Road, Mottram, Hyde, Cheshire, SK14 6NF, United Kingdom

[21] Appl. No.: 256,240

[22] PCT Filed: Jan. 4, 1993

[86] PCT No.: PCT/GB93/00001

§ 371 Date: Jul. 1, 1994

§ 102(c) Date: Jul. 1, 1994

[87] PCT Pub. No.: WO93/12848

PCT Pub. Date: Jul. 8, 1993

[30] Foreign Application Priority Data

Jan. 2, 1992 [GB] United Kingdom ..... 9200109
Jul. 22, 1992 [GB] United Kingdom ..... 9215536

[51] Int. Cl.[6] ..... A63F 3/00; A63F 9/20; A63F 9/04

[52] U.S. Cl. ..... 273/243; 273/254; 273/292; 273/146

[58] Field of Search ..... 273/248, 258, 273/243, 254, 284, 292, 293, 146

[56] References Cited

U.S. PATENT DOCUMENTS

| | | | |
|---|---|---|---|
| 3,073,601 | 1/1963 | Baillo | 273/284 |
| 4,070,026 | 1/1978 | Cambardella | 273/254 |
| 4,211,419 | 7/1980 | Larsen | 273/248 |
| 4,813,678 | 3/1989 | Collazo et al. | 273/243 |
| 5,085,441 | 2/1992 | Jova | 273/248 |

*Primary Examiner*—Benjamin H. Layno
*Attorney, Agent, or Firm*—Salter & Michaelson

[57] ABSTRACT

A board game having a game board, tokens and a random indicator which may be tiles or dice. The game board has a playing surface defined by a matrix of spaces, and the random indicator is used to direct the movement of the tokens across the surface. The tiles or dice each have faces thereon, wherein each face bears three types of indicia. One type of indicia indicates the direction of movement of the token, either forward or backward, the second type of indicia indicates the amount of movement of the token, and the third type of indicia indicates the axis of reference the token is supposed to move along.

30 Claims, 22 Drawing Sheets

BOARD GAME HAVING A RANDOM INDICATOR FOR DETERMINING DIRECTION, AMOUNT AND AXIS OF REFERENCE OF MOVEMENT OF TOKENS

This invention relates to an apparatus for playing a game and more particularly it relates to a dice.

Many games incorporate an element of chance. This element of chance is often provided for by throwing a dice or selecting a printed card at random. A problem with the latter arrangement has been that is the card is lost, the game cannot be played as intended. Also the production of custom cards for a game has added to the expense of the game.

SUMMARY OF THE INVENTION

According to a first aspect of the present invention there is-provided a playing apparatus, having a plurality of faces, a first set of symbols on some of the faces, and a second set of symbols on different faces, wherein the faces bear indicia providing at least a third and fourth grouping of symbols, so that the symbols, the grouping into a first or second set and the grouping into a third or fourth set respectively provide three mutually unassociated criteria of movement, variations or consequences on at least some of the faces of the apparatus.

Preferably, the first set of symbols is indicative of forward movement and a second set of symbols are indicative of a rearward movement.

Preferably, the third set of symbols represent a first player's move and the fourth set of symbols represent a second player's move.

Preferably, one set of symbols represent movement along one axis of reference and at least one other set of symbols represent movement along at least one other axis of reference.

BACKGROUND OF THE INVENTION

Preferably, at least two sets of symbols represent movement involving different games or different variations of, or consequences in, a game.

Preferably, at least two sets of symbols represent for at least two players an element of chance to be predicted.

The apparatus may be in the form of a dice. Preferably, a symbol is provided which if selected has no effect on the position of play. A symbol may also be provided which indicates a variable score. A symbol may also be provided and, if selected, may permit a player to select a particular move either for himself or his opponent. The term "selected" is intended to include an action of choosing as well as a throwing action. Accordingly in one embodiment the apparatus may take the form of tiles or tokens which may be selected at random from a bag.

Preferably, the expected results may be selected from the group of positive and negative numbers.

The term "expected result" is defined as the sum of the products of individual scores, or results, multiplied by their associated probability of occurring. Heretofore the expected result of a dice has always been positive, thus enabling overall forward movement in a game. The expected result of a regular six sided dice is: $\frac{1}{6}\times(1+2+3+4+5+6)=2\frac{1}{6}$. Because the dice of the present invention has negative numbers appearing on some faces it is now possible to have an expected result which provides for overall negative movement in a game. That is an expected result less than zero.

Reference is made to a 14 faced die in the book "Board and Table Games" by R. C. Bell, published by Oxford University Press 1969. However, no mention is made of a twenty faced die and accordingly this playing apparatus offers the advantage over existing dice in that more possible variations in play may be achieved, when playing with it.

Preferably, each face of a twenty sided dice is an equilateral triangle. Sets of symbols may be provided on different faces which indicate different moves, for example, backward, forward or no movement or a choice of movement. Means may be provided so as to distinguish each set of symbols from each other set of symbols. Means may be provided so as to distinguish the symbols of the first set of faces from the symbols of the second set of faces. The distinguishing means or symbols may serve to subdivide the symbols so as to enhance play, by incorporating the first and/or the second aspect of the present invention.

Preferably, a symbol may be provided on at least some of its faces, which symbol has no effect on the position of play and is of a size which allows the application of further indicia to the symbol. Typically, a positive number is displayed in a background which is in the shape of a plus sign, which sign is of a size which allows the application of further indicia and/or a negative number is displayed on a background which is in the shape of a minus sign, which sign is of a size which allows the application of further indicia.

In a preferred embodiment symbols are provided on different coloured backgrounds which act as indices. The colour of each index, or background, of the face which shows uppermost when the dice is cast could be a sign for a particular player, or team, during play or to a particular token of a player.

If there are twenty faces to the dice, ten of these faces preferably appear on a dark background and the remaining ten appear on a light (for example, white) background. On nine of the dark faces and nine of the light faces symbols indicative of a number between plus five and minus three including zero appear, making a total of eighteen. On the nineteenth face a star appears on a dark background. On the twentieth face a star appears on a light background. The star may be used to indicate a different number (for example, plus six) or may provide a random chance element so that, when thrown, it enables the person to whom the particular colour (that is, dark or light) corresponds to select his or her score at that turn or for that person's score at that turn to be selected by the person who threw the dice.

The references to dark and light backgrounds and to differently coloured backgrounds apply mutatis mutandis whatever the nature of the attributes that may differentiate the backgrounds of the first set of faces from the backgrounds of the second set of faces and also apply mutatis mutandis whatever the nature of the attributes that may differentiate the symbols of the first set of faces from the symbols of the second set of faces.

According to a seventh aspect of the present invention there is provided a dice comprising a plurality of tiles or tokens.

Provided that the expected result is greater than zero then overall forward play is possible. The expected result is defined as the sum of individual scores multiplied in each case by the corresponding probability of that score occurring.

Rules may be provided so as to allow the person to whom the particular colour corresponds to select a move for himself or herself. Alternatively, rules may be provided so as to allow the person throwing the dice, if the colour shown corresponds to his or her opponent's colour or token, to select a move for his or her opponent. The dice could therefore be used in such games as "snakes and ladders" and if such a situation arose then in the first alternative a player could choose a number which would allow himself or herself to move on to a square having the foot of a ladder on it and therefore move to a higher square, or in the second alternative a player could choose a number which would force his or her opponent to move on to a square having a head of a snake on it and therefore relegating his or her opponent to a lower square. Other variations in rules may be provided which permit a player to re-throw or choose another score.

A preferred embodiment of the apparatus is a regular icosahedron. For there to be an equal chance of any symbol on the dice being thrown, each face of the dice must be the same size and shape.

Each symbol used on the dice must be immediately recognisable, whichever way round it is shown.

Preferably positive numbers are shown by white spots on a black background in the shape of a plus (+) sign. When a positive number is thrown, the relevant counter is moved forwards that number of spaces.

Preferably negative numbers are shown by white spots on a red background in the shape of a minus (–) sign. When a negative number is thrown, the relevant counter is moved backwards that number of spaces.

Preferably each zero is shown in blue. When a zero is thrown, the relevant counter would normally remain where it was just as if a turn has been missed. But the players agree before the game starts or if the rules of the game so provide, throwing a zero could be treated as a move by the relevant counter corresponding to the background against which that zero appears. The same space may be occupied as on the previous throw so that any award or penalty given for landing on that space will be repeated.

Preferably each star is shown in yellow, and subject to the rules of the game may take any value from +6 (plus six) to –3 (minus three), including 0 (zero), as decided in the first alternative by the player whose counter is to be moved or in the second alternative by the player who threw the dice. The first alternative would apply unless the rules of the game provide otherwise or the players agree otherwise before the game starts. The background of the face which is shown uppermost after throwing decides which counter is to be moved.

One purpose of the different backgrounds (which are here called "dark" and "light") is to control which counter is to be moved. For example if two players are playing and one is Player A and the other is Player B, it may be decided that player A's counter is controlled by the light backgrounds, and player B's counter is controlled by the dark backgrounds. Then, for example: A throws light +2, and moves his counter forward 2 spaces. B throws dark –3, and moves his counter back 3 spaces. A throws dark +5, and B moves B's counter forward 5 spaces. B throws light *; if the first alternative applies, A, not B, decides what value to give to the star, say 4, and moves his counter forward accordingly.

If each player (or a single player) has two counters, one counter could be controlled by the light backgrounds and the other by the dark backgrounds.

In a different version two teams may compete against one another. Each team may have two players with one counter each. The counter of one player in a team could be controlled by the light backgrounds, and the counter of the other member of that team could be controlled by the dark backgrounds.

If the players so agree before the game starts, the light and dark backgrounds are ignored and each player throws the dice only for his or her own counter.

If a game requires a 6 (on a conventional dice) to be thrown before a player can start, the players may throw either a star or a zero in order to start, but if the players so agree before the game starts, they may decide either that a player must throw a star in order to start or that a player must throw a zero in order to start.

Preferably the number or symbol which appears on any face of the dice also appears on the opposite face of the dice, but with the other background colour.

Because of the differently coloured backgrounds a player may throw a number or symbol for his or her opponent, or may control two counters at the same time. This means that a single player can play board games with the dice, on his own.

On a conventional dice the numbers are shown by spots arranged to fit the faces of the cube. In the preferred embodiment the positive numbers are shown by spots arranged on the arms and/or the centre of a plus (+) sign, and the negative numbers are shown similarly on a minus (–) sign. Also the variable number (which has any value from +6 to –3) has its maximum value of +6 shown by the spokes of the star symbol, and the zero is shown by a circular 0.

The following must be immediately distinguishable from each other, namely:

(a) each dot (meaning any spot or other distinguishing mark or sign on a symbol) from the rest of the symbol on which it appears;

(b) each symbol from the background of the face on which it appears;

(c) the backgrounds or other means indicating the first set of faces from the backgrounds or other means indicating the second set of faces.

Such distinctiveness may be achieved by using any or all or any combination of the following means, namely;

(1) differences of colour;

(2) different intensities of colour;

(3) monochromatic contrast;

(4) differences of texture;

(5) differences of surface-level;

(6) a contrasting border between a dot and the rest of the symbol on which it appears and/or between a symbol and the background of the face on which it appears;

(7) a rim or a groove between a dot and the rest of the symbol on which it appears and/or between a symbol and the background of the face on which it appears;

(8) differences in reflectivity;

(9) differences in pellucidity or opacity;

(10) differences in warmth or coldness to the touch;

(11) by different materials being used;

(12) by any other means which provide sufficient contrast either visible or tangible or visible and tangible.

By using any or all or any combination of such means as may be appropriate, the dice may (depending upon the particular means and/or embodiment) be read either by sight or by touch or by sight and touch and so be used by any or all of the following persons, namely:

(i) the normally-sighted;

(ii) the colourblind;

(iii) those suffering from disorders of vision;

(iv) the visually handicapped;

(v) the blind.

Another aspect of the present invention relates to apparatus for playing a game.

The apparatus in particular relates to board games in which a playing surface is employed on which one or more counters or tokens, representing one or more players, move towards a predetermined location or goal.

The present apparatus is particularly well suited for use with the aforementioned dice apparatus.

Furthermore it will be appreciated that the apparatus of the present invention is particularly well suited as an educational aid and also in that role, it is not limited to use with the aforementioned dice.

According to an eighth aspect of the present invention apparatus for playing a game comprises: a playing surface defining a plurality of regions;at least one token capable of moving across the surface from a first region to a second region; means for indicating a first base vector (i) and a second base vector (j), which base vectors determine the direction of movement of the token and means for indicating separate scalar values (A and B), the scalar values determining the magnitudes of first and second vectors (Ai and Bj) such that a resultant vector, indicating overall movement of the token is determined by the sum of the two vectors Ai+Bj.

According to a ninth aspect of the present invention apparatus for playing a game comprises: a playing surface; a plurality of regions defining a matrix disposed on the said surface and at least one token arranged to move under the direction of a random indicator, the token being movable from a first region of the matrix to a second region of the matrix under the influence of the indicator, characterised in that the random indicator is capable of indicating the amount of movement in at least two independent directions simultaneously.

So far mention has been made of means being adapted to indicate an absolute direction or sense. For example a negative symbol has indicated that movement should be backwards, anticlockwise or whatever reverse sense is required by a game to place a player at some disadvantage. In the embodiments described below the term "means to indicate" or "means for indicating" is intended to include an indicator that a particular player or team is to move or play and/or that a particular player or team is to move parallel to a specific axis or in a certain sense or in a particular direction defined by one or more "base vectors". Such indicative means could include a background colour or shade, or any or all of any combination of the distinguishing means aready described.

Preferably the independent directions are perpendicular to one another, similar to the arrangement of axes on a graph whose coordinate system is determined by the Cartesian coordinate system. However, different directions may be governed by other coordinate systems, such as for example, a coordinate system similar to or based upon the polar coordinate system. Of course independent directions are not limited to these two types of coordinate systems and any playing surface or space having at least two possible independent directions in which a token may move, may be used.

Movement in either direction may be in a forward or backward sense. Similarly if a system based on polar coordinates is used the sense of direction may either be clockwise or counter-clockwise as determined by a suitable indicator, such as a negative symbol disposed on some faces of a dice. As such a dice is described above for ease of understanding the present invention the polyhedral embodiment of it will be referred to as a "matrix dice".

Preferably, more than one player can play at the same time. Each player may have a predetermined start position where his or her token is placed prior to the commencement of a game and each player may have a predetermined end position or positions. The end position may be determined randomly or by agreement. One way in which selection of the end position may be made is by selecting a card at random. Alternatively, the or each end position may be printed or applied to the playing surface. Preferably, in such apparatus a symbol is provided, which symbol indicates a variable score.

Each player may start at a different position and may have different frames of reference. That is, a positive or forward direction for one player, may represent a negative or backward direction for another player. For example if a rectangular playing surface is used with a regular rectangular grid of locations and there are two players, with each player starting at diametrically opposite corners, then a move of 1 forwards and 1 up for a first player will represent a move of 1 backwards and 1 down for the second player. Accordingly it may be preferred to arrange one or more displacement indicators adjacent to one or more edges of the playing surface so as to indicate a positive and negative direction for each player. These may take the form of coloured lines with arrows showing a direction play for that player.

A player may have to traverse a predetermined network of positions. At each position points may be awarded or an advantage may be gained. Points may take the form of money vouchers, cards or any other suitable score indication means, with the result that the winner is the first to reach a predetermined score, or the player having the most points. Advantages may take the form of cards with a name of a planet, town, city or street. For example the playing surface may represent the solar system and predetermined positions for the planets may be indicated. These positions may be variable, chosen by agreement or by random selection. An object of such a game may be to visit a certain number of planets. The winner may be the player to visit all planets first or the player who reaches the most planets. Variation may be made so that a player visits towns or streets or famous buildings.

Other variations may be made by replacing planets with stars, galaxies or the like, thus creating a game with an educational element. Further alternatives include playing surfaces indicating the world's surface, in the form of a map showing capital cities or a map of the moon's surface. A topological map of, for example, a network of lines of communication linking cities, or suburbs of a city may be superimposed on the grid. Such a network may include a map of an underground train system.

Players may decide to visit certain destinations before commencing a game.

Yet more embodiments include playing surfaces in the form of graphs; sales charts; pie charts; town plans; building plans; a matrix displaying letters of the alphabet, numbers and/or shapes; a surface in the form of a maze or representing a developed surface of a solid such as a cone or a cylinder. The playing surface may be in the form of sheet music and a player may move from left to right only; but up as well as down. Thus a musical score may be followed.

Additional embodiments include the whole or part of the surface (whether the outside or the inside of such surface) of a solid such as, for example, a sphere, an ovoid, a cone, a cylinder, a solid of revolution, and a polyhedron. Such embodiments include a terrestrial globe with degrees of latitude and longitude shown on it; a celestial globe; and a lunar globe depicting the geographical features of the moon.

Where the embodiment is a terrestrial globe, the object of a game played on it might be to visit cities and towns throughout the world, with each player selecting the city or town which he or she would visit next by a card chosen at random from a set of cards supplied with, or obtained for use with, the game, the score on reaching that destination being the distance in miles (or alternatively in kilometres; the standard of measurement would be the same throughout a game) between that destination and the city or town last previously visited. Details of all distances would be supplied with the set of cards. Each player would move in turn. When all the cards had been used, either the game would end when a player next reached his or her destination, or the cards not in play would be shuffled and play would continue for another round. Alternatively the game would end on the expiry of a predetermined time. At the end of the game the player with the highest score would be the winner.

Variations on this last mentioned game would include games where the object is to fly between airports; or to sail between ports; or to travel to map references and to say what is located at that map reference. Different sets of cards could be produced for use with the same game. In another variation the embodiment would be a lunar globe, and the object of a game played in it might be to visit different geographical features on the moon.

The abovementioned surfaces may appear on the transparent or translucent material, enabling them to be placed above a grid and replaced when players wish to play a different game or when different age groups wish to play.

Provision could be made for means by which counters or tokens could be temporarily secured in position on or over a playing surface, thereby enabling, for example, the whole of a spherical playing surface to be used. As an example, one means which could be used for this purpose is magnetism.

It might be thought that play may be enhanced by employing one or more icosahedral matrix dice or domino dice as described herein.

Thus according to a further aspect of the present invention there is provided, a playing apparatus consisting of a single polyhedron having on its faces a plurality of symbols, one symbol to each face, the faces being grouped into at least two sets, so as to enable a random score to be generated according to three criteria (such as, for example, distance of movement, and axis of reference) simultaneously on one turn of such playing apparatus.

Preferably, if the playing apparatus is in the form of a dice, the number or symbol which appears on any face thereof with one of two background colours also appears on the opposite face of the dice, but with the other background colour.

In a preferred embodiment each tile or token or card has on its single face one of a plurality of symbols against one of at least two backgrounds. Each tile or token or card is in the form of a domino in that two symbols appear on the face thereof, one symbol (which is against one of at least two backgrounds) being at one end of the tile or token or card, and the other symbols (which is against a different one of the said backgrounds) being at the other end thereof.

According to a still further aspect of the present invention there is provided a playing apparatus consisting of a plurality of tiles or tokens or cards, (not including playing cards) wherein each tile or token or card has on its single face one of a plurality of symbols, the symbols of such playing apparatus being grouped into at least two sets, so as to enable a random score to be generated according to up to three criteria (such as, for example, distance of movement, direction of movement and axis of reference) when such a tile or token or card is selected at random.

According to an additional aspect of the present invention there is provided a playing apparatus consisting of a plurality of tiles or tokens or cards, wherein each tile or token or card is in the form of a domino in that two symbols appear on the face thereof, one symbol (which is against one of at least two backgrounds) being at one end of the tile or token or card, and the other symbol (which is against a different one of the said backgrounds) being at the other end thereof, so as to enable two random scores to be generated according to up to three criteria (such as, for example, distance of movement, direction of movement and axis reference ) when such a tile or token or card is selected at random, save that where the axis of reference is indicated by the background the same background would not appear at both ends of the same tile or token or card.

Preferably, freedom of movement in each direction along each axis is possible, but which may be changed at will in this respect by temporarily removing therefrom certain of the tiles or tokens or cards so as to limit movement along any or several or all of the axes of reference to overall forward movement, or to backward movement only, as may in each case be appropriate.

Such means may be used to distinguish between the spots or marks on the symbols, the symbols, and the backgrounds, as to be (depending upon the particular means and/or embodiment) read either by sight or by touch or by sight and touch.

The playing apparatus may be a random number generator similar to a roulette wheel (whether manually operated or motorised) in which the symbols allocated to the various compartments in which the ball may come to rest and the respective backgrounds of those compartments provide for the simultaneous random selection of three criteria, such as, for example, distance of movement, direction of movement and axis of reference.

In a preferred embodiment of the foregoing a positive number is displayed on a symbol in the shape of a plus sign and a negative number is displayed on a symbol in the shape of a minus sign. A third symbol is provided, which symbol has no effect on the position of play. A fourth symbol is provided, which symbol indicates a variable score. Movement can be selected from at least three axes of reference, thereby enabling movement in three dimensions.

A game may have a playing apparatus whereby a player can select tiles or tokens or cards at random at the commencement of the game and, where appropriate, subsequently in that game, and play each move represented thereon in the order in which he or she thinks best and in such embodiments there may be at least three axes of reference. Thus a game may be played wherein movement in three dimensions is possible. The playing surface of such a game may be the whole or part of the surface (whether the outside or the inside of such surface) of a solid.

In a preferred embodiment of the game the playing surface shows, along each side, the colour of the background which controls movement along that axis. The playing surface may be a square board having on it four separate pairs of axes of reference, that is, one pair for each of up to four players. Each player may start from a different position on the playing surface and each player may have different frames of reference, that is, a positive or forward direction for one player may represent a negative or backward direction for another player. The matrix or the games board or both may be pellucid, so that one can be placed over the other or inserted in the other. There may be interchangeable sets of matrices and boards (or inserts and/or slides and/or other devices). The game may be adapted to be played with a playing apparatus according to any of claims 1 to 22 and 30. The game with the aforementioned features may be adapted to be played with the aforementioned playing apparatus.

Embodiments of the invention will now be described by way of several examples only, and with reference to the figures in which:

DESCRIPTION OF THE PREFERRED EMBODIMENT

Figure 1:
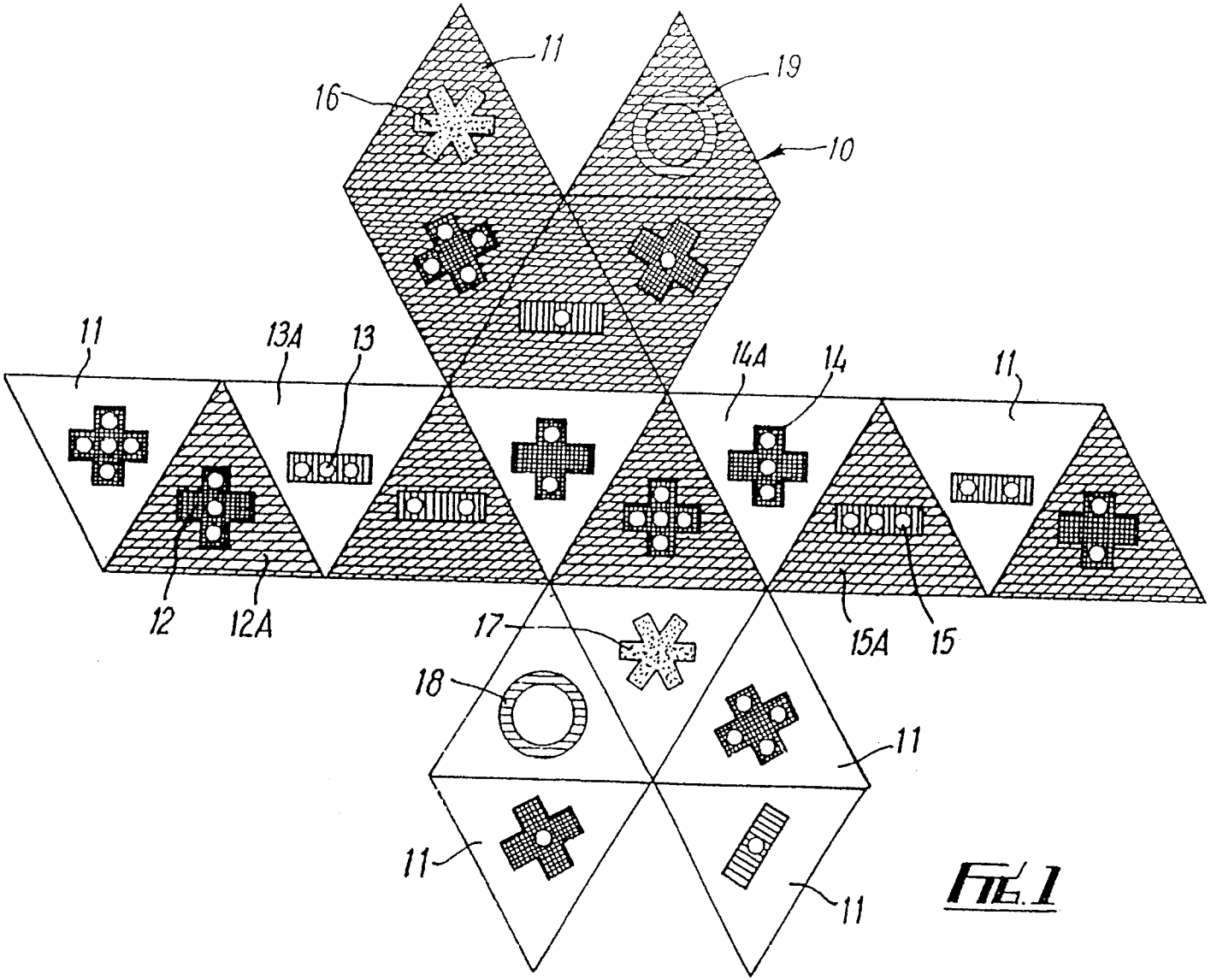
FIG. 1 is a developed representation of an icosahedron showing twenty faces on regular equilateral triangles.
Figure 2:
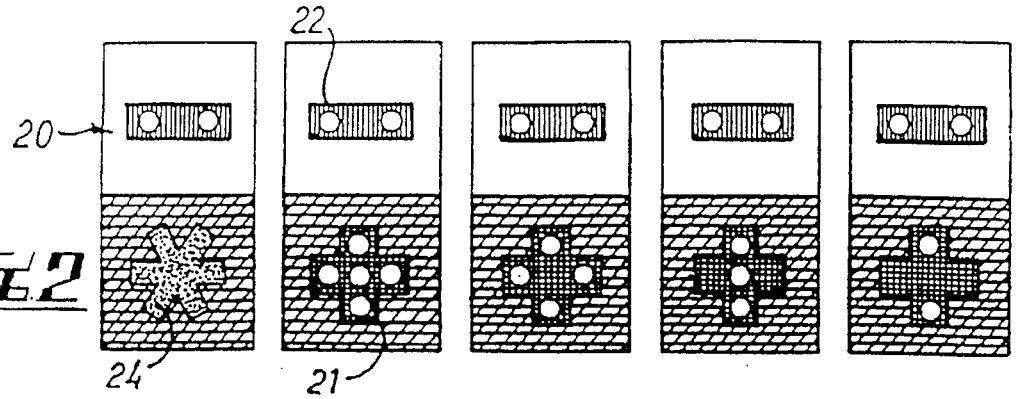
FIGS. 2 to 21 are plan views of tiles.
Figure 3:
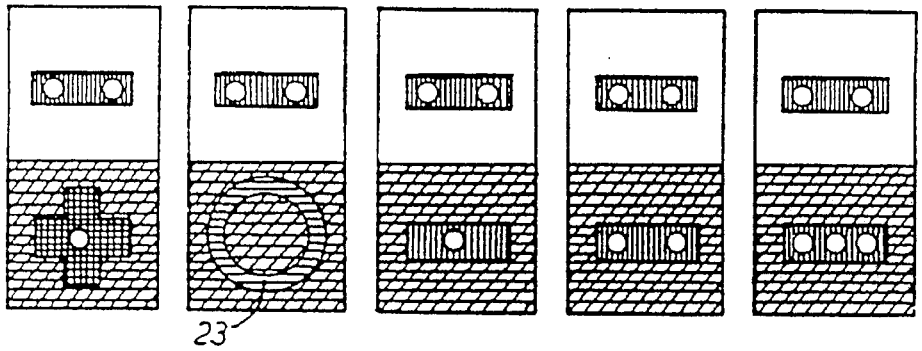
Figure 4:
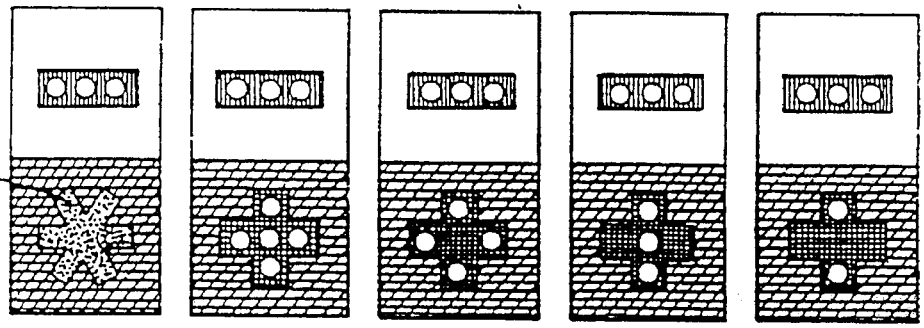
Figure 5:
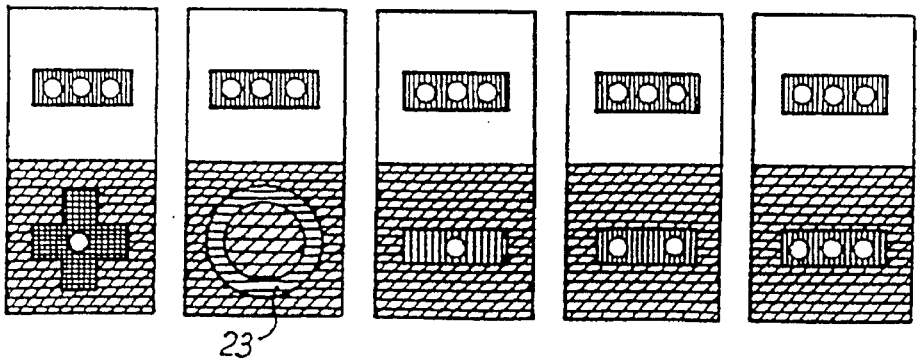
Figure 6:
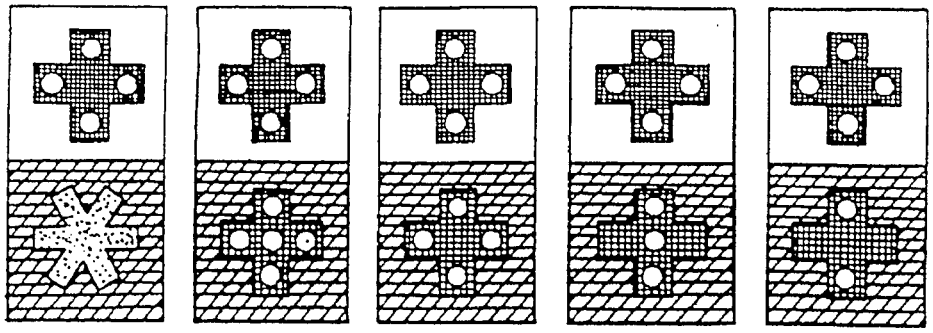
Figure 7:
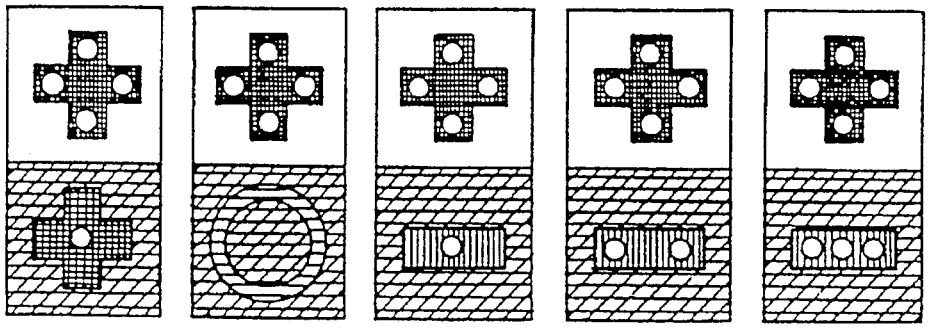
Figure 8:
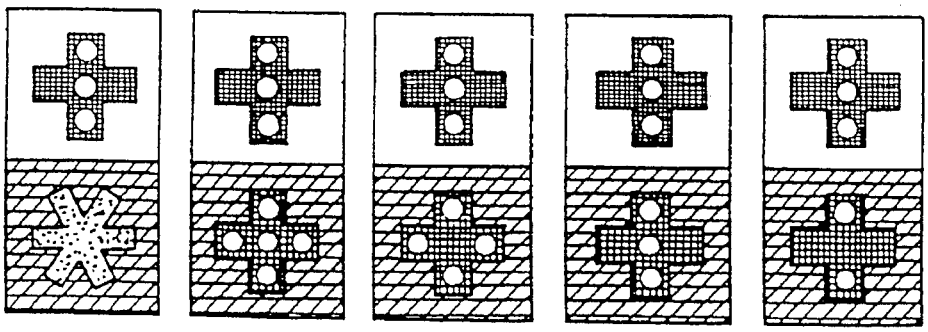
Figure 9:
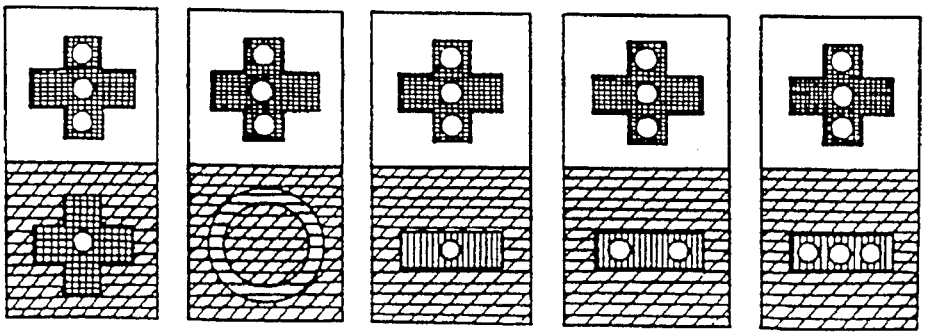
Figure 10:
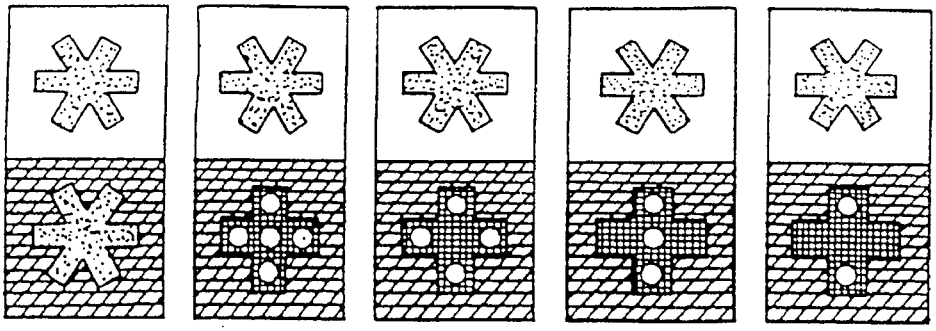
Figure 11:
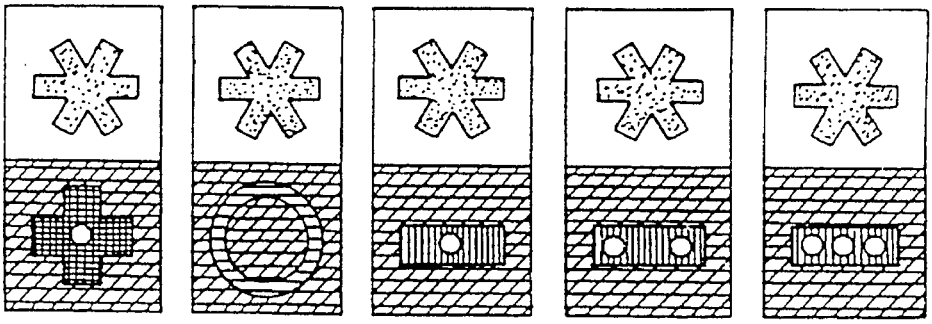
Figure 12:
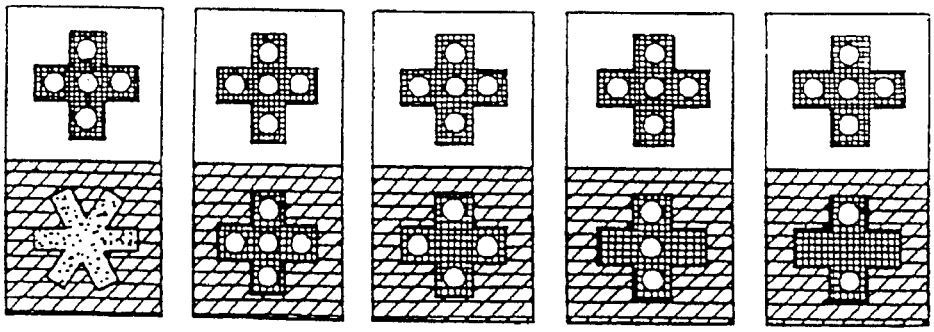
Figure 13:
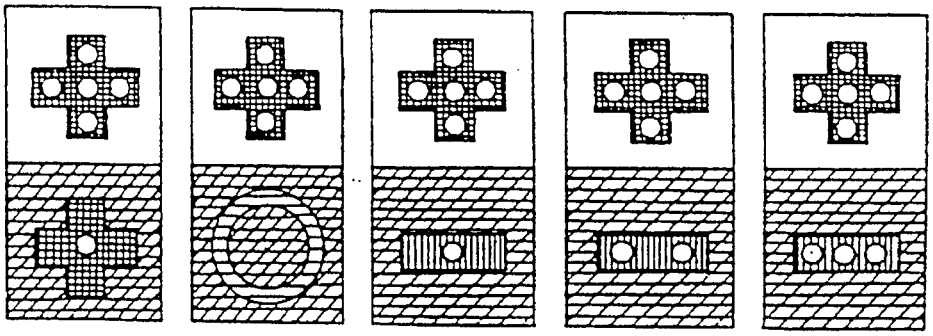
Figure 14:
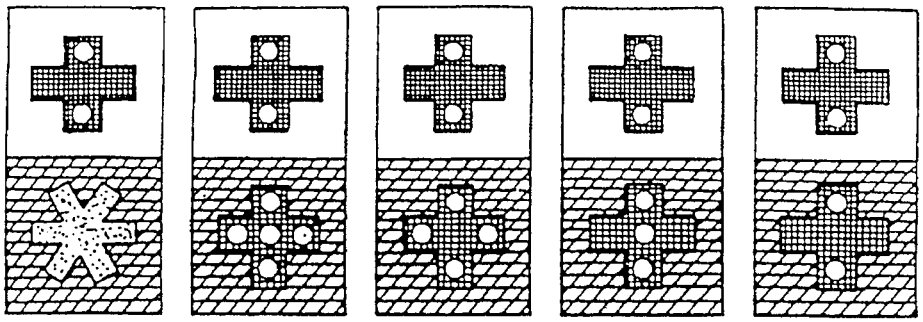
Figure 15:
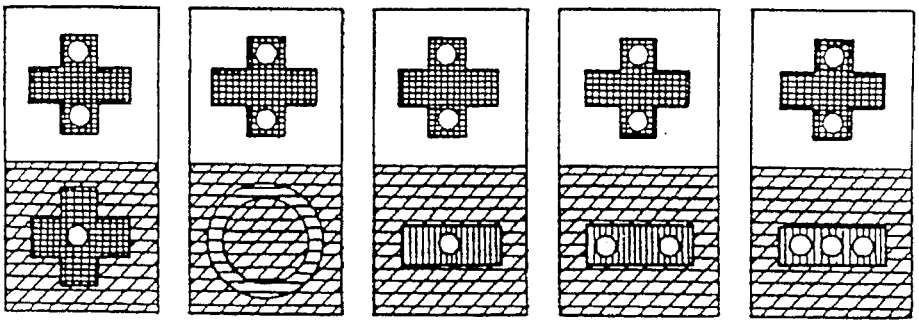
Figure 16:
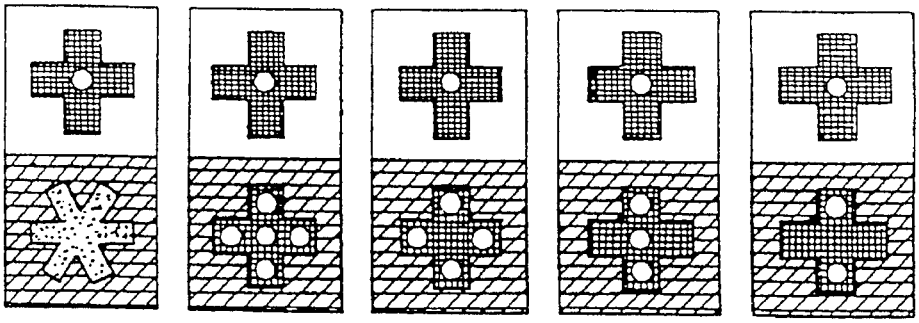
Figure 17:
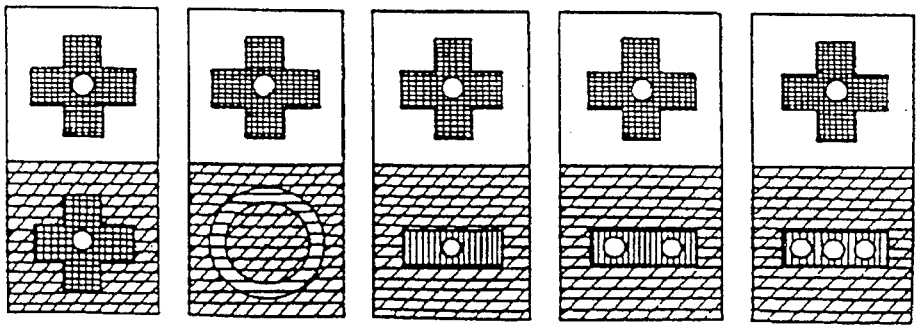
Figure 18:
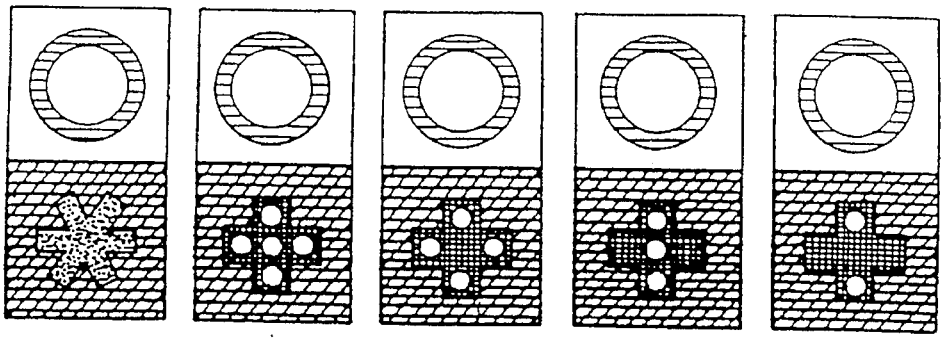
Figure 19:
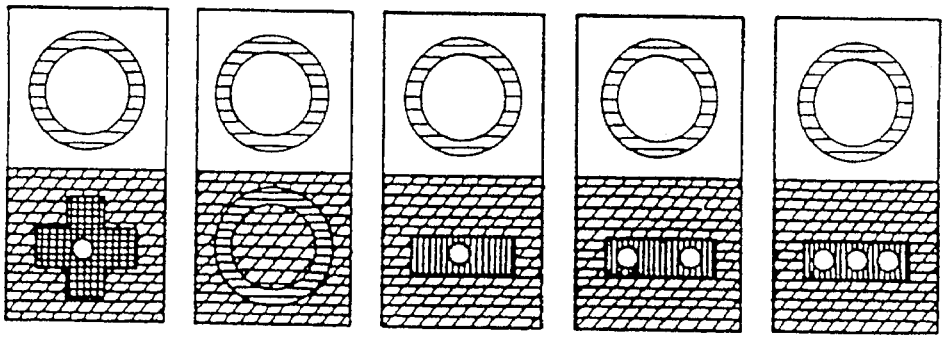
Figure 20:
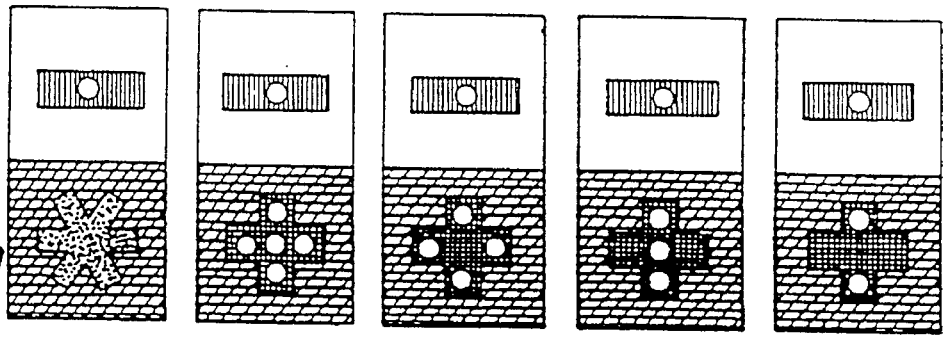
Figure 21:
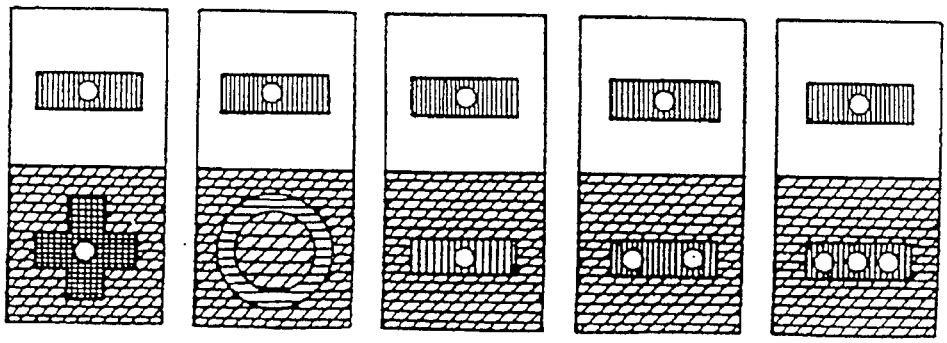

Referring to FIG. 1 a developed surface of a dice is shown generally at 10. The dice 10 consists of twenty equilateral triangles 11. Each triangle 11 is in contact with at least one other triangle along one of its edges and when the dice is assembled is in contact with three other triangles, that is, with one other triangle along each of its edges. Ten of the triangles are shaded with a dark background. The other ten appear on a light background. Three white dots appear on a + sign 12 on a dark background 12A. Three white dots appear on a − sign 13 on a light background 13A. These symbols, if appearing uppermost when the assembled dice is thrown, indicate a movement of three spaces forward for the player represented by dark and three spaces backwards for the player represented by light respectively. Corresponding faces appear at opposite faces of the assembled dice 10. Thus the three white dots appearing on the + sign 14 on the light background 14A appear opposite the + sign at 12; and the three white dots on the − sign 15 appearing on the dark background 15A appear opposite the − sign 13.

A star 16 appears on a dark background and a star 17 appears on a light background. If either of these is thrown then the player to whom the background corresponds may select his or her move. A zero 18 appears on a light background and a zero 19 appears on a dark background and similarly if these appear uppermost after a throw then the player to whom the background colour corresponds does not move. The aforementioned rules operate irrespective of whether the player moving is the player to have thrown the dice. (Alternative rules for the use of the star and the zero are available as aforesaid.) It will be appreciated that different numbers may be used on the faces or the faces may be placed in different orientations relative to one another as it is not the relative spatial relationship which determines the outcome of a throw rather the fairness of the dice.

The tiles shown in FIGS. 2 to 21 respectively show an alternative embodiment of the playing apparatus. Each tile is in the form of a domino in that two symbols are represented on it, one of these being at one end of the tile and the other being at the other end of the tile. For this reason the playing apparatus will be referred to as domino dice. There are one hundred domino dice 20 in each set. Each domino dice 20 has a light background at one end and a dark background at the other end. On each background there appears a symbol. The symbols used are the same as the symbols shown and have the same effect as those in FIG. 1. Because there are ten symbols and each of the symbols may appear with itself, there are one hundred possible combinations.

Positive numbers are shown by white spots appearing on a black plus (+) sign 21. Negative numbers are shown by white spots appearing on a red minus (−) sign 22. A zero 23 and a star 24 also appear. Play commences by placing all the domino dice in a bag, mixing the bag thoroughly and then selecting one or more domino dice from the bag and playing in accordance with the symbols appearing on each such domino dice. The same rules are applicable on selection of a domino dice showing a zero or a star, as for throwing the dice described above. The light and dark backgrounds serve the same purpose as they did on the dice. That is to indicate which counter is to be moved. Similarly if players operate more than one counter the corresponding colours of the backgrounds may be used to control each counter.

Rules may be provided which enable a player to select more than one domino dice at the commencement of a game and to play each move represented on each such domino dice in the order in which he or she thinks best. In this embodiment therefore the element of chance may be minimised and one player may play his domino dice in an entirely different order from another player. Whenever a player plays a domino dice he or she places it face upwards on the table so that everyone can see it, and the players make their moves accordingly. The domino dice is then taken out of play, and placed for example in a box, but not in the bag in which the other domino dice are contained. The player who played then takes another domino dice out of the bag and waits for his or her next turn.

When the bag is empty the domino dice taken out of play are replaced into the bag, shaken and play may continue. A player may change all or some of his or her remaining domino dice whenever he or she plays a zero or a zero is played for him or her. Thus for example a player may choose the value of a star to be zero and in doing so may enable himself or herself to change all or some of his or her remaining domino dice. After taking the required number of substitutes out of the bag the player then puts into the bag the ones he or she has decided to change. The bag is then shaken to shuffle the domino dice and play continues.

Of course the domino dice could be used in a similar way to conventional dominoes, in which case suitable rules may be provided, for example a star could count as six and the differently coloured backgrounds could be ignored according to agreement between the players.

The domino dice therefore provide an interesting variation to dominoes whilst also providing a novel random selecting apparatus which enhances the play any board game requiring dice, by providing a negative and a selective number variation.

It will be appreciated that variation to the embodiments above may be made without departing from the scope of the invention, for example if players agree beforehand the differently coloured backgrounds on the domino dice could be used for matching. Similarly different colours symbols or shapes may be used. Of course variation in the range of numbers may also be permitted provided that the overall expected result is greater than zero where play is to proceed in an overall forward direction. Also if using the domino dice as dominoes, because there is no such thing as true doubles, variation may be made to enable such combinations as light +5 and dark +5 to be laid level with the other dominoes and not at right angles to them as is usually the case in traditional dominoes.

Of course it would be equally possible to have a dice with more or less than twenty faces. It would also be possible to have dice with faces of different shapes. More or less features may appear on such dice and these would be limited by the number of faces only. As will be appreciated a different range of positive to negative numbers may replace the above described range. Similarly the "zero" and/or "variable" score faces may be omitted; or more may be added, according to the number of faces.

It is, however, only the regular icosahedron which allows the use of the full range of positive to negative numbers from +5 to −3 described above, including the "zero" and "variable" (star) score faces, with two complete sets of faces, while at the same time giving an equal chance of any symbol on the dice being thrown.

Of course more or less features may appear on domino dice, and these will increase or reduce the number of possible combinations. A different range of positive to negative numbers may replace the above described range, and the "zero" and/or "variable" score faces may be omitted, or the "variable" score face given a different range of values. For example, the numbers on a set of domino dice could range from +9 to −5, including 0 (zero). For such a range, the numbers +9, +8, +7 and +6 could be represented in a similar manner to the numbers +5, +4, +3 and +2 respectively as already described, save that in each case there would be four extra spots which could be arranged either with one on each arm of the plus (+) sign near the centre of the sign or with one in each outer angle of the plus (+) sign; and the numbers −5 and −4 could be represented in a similar manner to the numbers −3 and −2 respectively as already described, save that in each case there would be two extra spots which could be arranged with one in each of the two positions which would be intermediate between the central and outer spots on the minus (−) sign on the symbol for −3. With such a range, the "variable" score face could have a symbol of a ten-pointed star and could take any value from +10 to −5, including 0 (zero), decided as previously mentioned. But if the players so agree before the game starts, or if the rules of the game so provide, a different value or range of values could be given to the variable score face.

A set of domino dice having a consecutive range positive and negative numbers from +9 to −5 including zero and the star (variable) would have 256 possible combinations and there would therefore be 256 domino dice in the set.

It would of course be possible for domino dice to be double-sided, but in such a case for there to be an equal chance of each combination to be drawn each combination (on whatever side of a domino dice) would need to appear either the same number of times or once only in any set. The second side of each domino dice in such a set could have the same symbols represented on it as on the first side but with the background colours reversed, so that a domino dice which, for example, has dark +4 and light −2 represented on its first side would have light +4 and dark −2 represented on its second side. In this case, play would be enhanced because a player could decide which side of a domino dice to play and this would increase the skill required.

In the event of a set of domino dice being double-sided, the number of pieces in a set could be halved, because if there were, for example, one hundred possible combinations, only fifty double-sided domino dice would be necessary for all combinations to be represented; if, however, there were one hundred double-sided domino dice in that set, with the second side of each domino dice in that set having the same symbols represented on it as on the first side but with the background colours reversed, play would be enhanced, firstly because exact pairing would be possible, and this would enable games to be played where exact pairing was required, and secondly because the double-sided nature of the domino dice would make pairing more difficult than with two sets of one-sided domino dice, since the two double-sided domino dice of a pair could be played with different faces uppermost with the result that they would not then be a pair.

Alternatively it would be possible for each domino dice of a double-sided set to have the same symbols represented on the second side as on the first side, but with a uniform neutral background colour on the second side, so that the second side could be used for different games such as games where true doubles were required such as −3 and −3 on a single domino dice.

Figure 22:
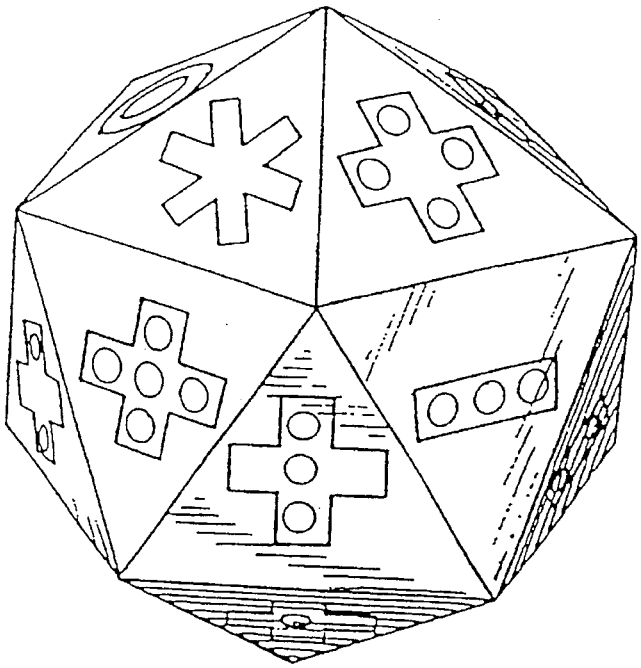
FIGS. 22 and 23 show isometric views of the assembled icosahedron of FIG. 1.
Figure 23:
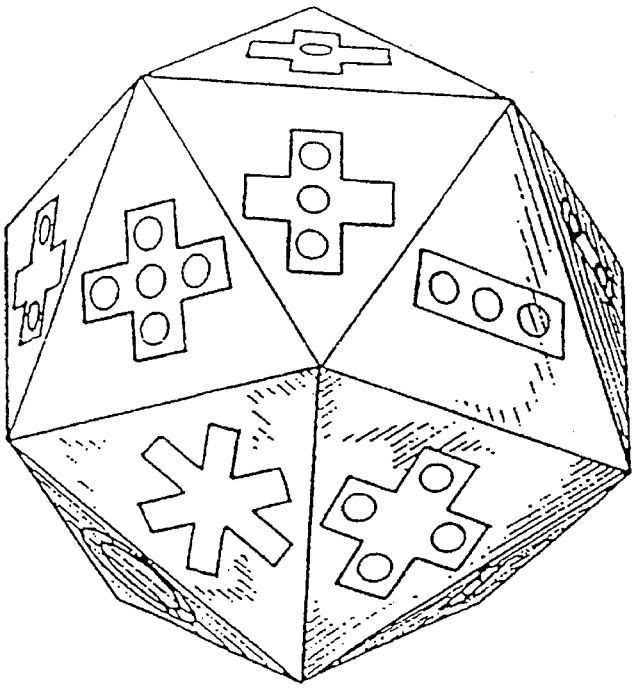

FIGS. 22 and 23 show overall views of the assembled icosahedral dice, as assembled from the developed surface shown in FIG. 1. Clearly different shapes and/or backgrounds may appear on each face.

Further embodiments will now be described with reference to FIGS. 24 and 25. Each playing surface has a matrix disposed on it such that each player moves his or her counter bidirectionally with reference to axes. If the axes of reference are the x-axis and the y-axis, and the light faces of an icosahedral matrix dice (not shown) or domino dice (not shown), control movement along the x-axis, the dark faces of the matrix dice or domino dice will control movement along the y-axis. This means that:

- if player A throws light +5 on a matrix dice, he or she will move his or her counter forward five spaces parallel to the x-axis;
- if player B throws light −3 on a matrix dice, he or she will move his or her counter backward three spaces parallel to the x-axis;
- if player A throws dark −2 on a matrix dice, he or she will move his or her counter backward two spaces parallel to the y-axis;
- if player B throws dark +4 on a matrix dice, he or she will move his or her counter forward four spaces parallel to the y-axis;

If a player using domino dice plays light +3/dark +2, he or she will move his or her counter three spaces forward parallel to the x-axis and two spaces forward parallel to the y-axis.

Because the playing surface is designed for bidirectional movement, and movement is relative, for some games where overall forward movement is required, there could be four separate pairs of axes of reference ona square board, that is, one pair for each of up to four players. Each pair of axes is in a different colour, for example RED, YELLOW, GREEN and BLUE. Directional arrows on each axis show which direction is forwards for that particular axis. Additionally, the playing surface shows, along each side, the colour of the background which controls movement along that axis.

The square matrix is particularly suitable for use with the icosahedral matrix dice. The number of spaces, and what, if anything, they contain depends on the game for which that particular playing surface is designed. In the illustration in FIG. 24 the player with the red counter starts in the space in the corner adjacent the intersection of the red axes and finishes on reaching the corner diametrically opposite it. Similarly, the player with the green counter starts in the space in the corner adjacent the intersection of the green axes and finishes on reaching the corner diametrically opposite it, and so on.

The fact that each pair of axes intersects off the playing area of the games board does not matter, because movement indicated by the resultant displacement vector Ai+Bj is calculated from the last position of the relevant counter on the games board immediately before the matrix dice is thrown or the domino dice is played, with reference to the frame of reference according to that player's colour.

The axes of reference need not necessarily intersect in a corner of a games board, or at right angles; they might, for example, intersect in its centre (as on a gun sight), or they might intersect at an acute angle or at an obtuse angle. In either of the two last mentioned cases the spaces would be rhombi or rhomboids.

The axes of reference need not necessarily be straight lines, or have absolute position; they might, for example, be the radius and circumference of a circle of variable radius, in which case the matrix would have the form of a set of concentric circles intersected by lines proceeding from the same centre.

If one axis of reference is the radius, and the other the circumference, movement with reference to the first axis would be radial, that is, in a forward direction it would proceed from the centre, and in a backward direction it would proceed towards the centre, or vice versa; and movement with reference to the other "axis" would be rotational, that is, in a forward direction it would proceed clockwise, and idn a backward direction it would proceed counterclockwise, or vice versa. In FIG. 25 the thick circular line indicates that that is the background colour which controls rotational movement.

If the embodiment of a playing surface is the curved surface of a cylinder, and one axis of reference is its length, and the other its circumference, movement with reference to the first axis would be linear, that is, in a forward direction it would proceed from one end of the cylinder towards the other, and in a backward direction it would proceed in the reverse direction; and movement with reference to the other "axis" would be rotational, that is, in a forward direction it would proceed clockwise when viewed from one end of the cylinder, and in a backward direction it would proceed counterclockwise when viewed from the same end of the cylinder. The same principle applies when the embodiment of a playing surface is the curved surface of a cone or the curved surface of a solid of revolution.

Where the embodiment of a playing surface is a terrestrial globe, one axis of reference could be the circumference around the equator, with the other axis of reference being the circumference through the poles. In that event, movement with reference to the first "axis" would in a forward direction proceed towards the east, in a backward direction proceed towards the west, or vice versa; and movement with reference to the other "axis" could either (a) in a forward direction proceed towards the north, and in a backward direction proceed towards the south, or vice versa, or (b) in a forward direction proceed away from the equator, and in a backward direction proceed towards the equator, or vice versa. The preferred alternative is (a). The problem of crossing the equator which could arise in case (b) if the spaces for tokens or counters lay on each side of, but not on, the equator which could arise in case (b) if the spaces for tokens or counters lay on each side of, but not on, the equator could be met by having spaces for the tokens or counters on the equator, or alternatively provision could be made for the criterion as to what is forward or backward movement when a token or counter starts its move to remain in force until the token or counter has completed that move, notwithstanding crossing the equator in the course of that move. If movement in a forward (or backward) direction along one "axis" means moving away from the equator, a player with a token or counter on the equator who has a score authorising movement in that direction in relation to that axis could choose whether to move that token or counter to the north or to the south. Preferably where an embodiment of a playing surface is a sphere it would be marked with a line to identify the equator. These principles are not limited to terrestrial globes; they apply whenever the embodiment of a playing surface is a sphere or an ovoid.

Figure 24:
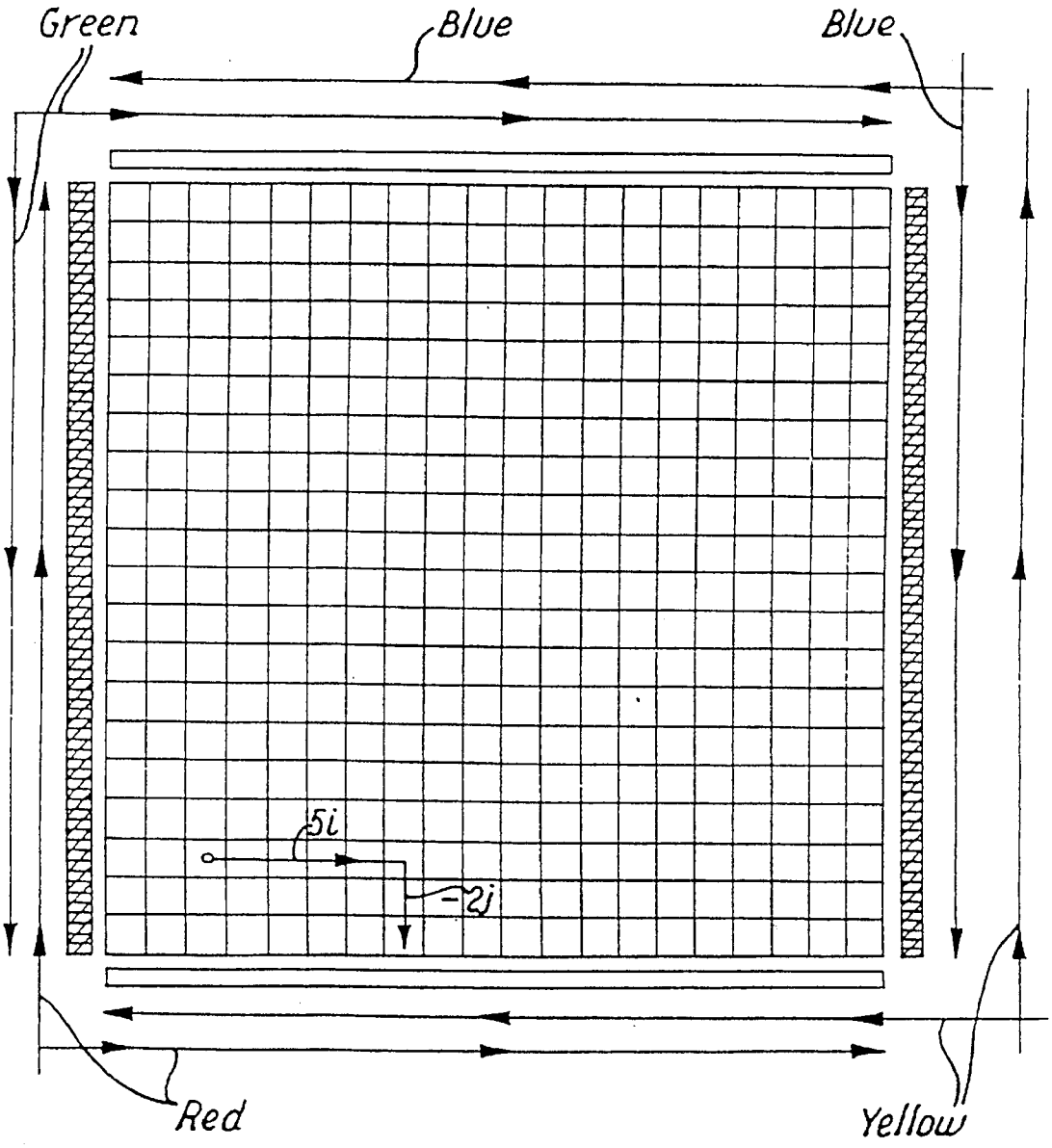
FIG. 24 is a plan view of one embodiment of a playing surface.
Figure 25:
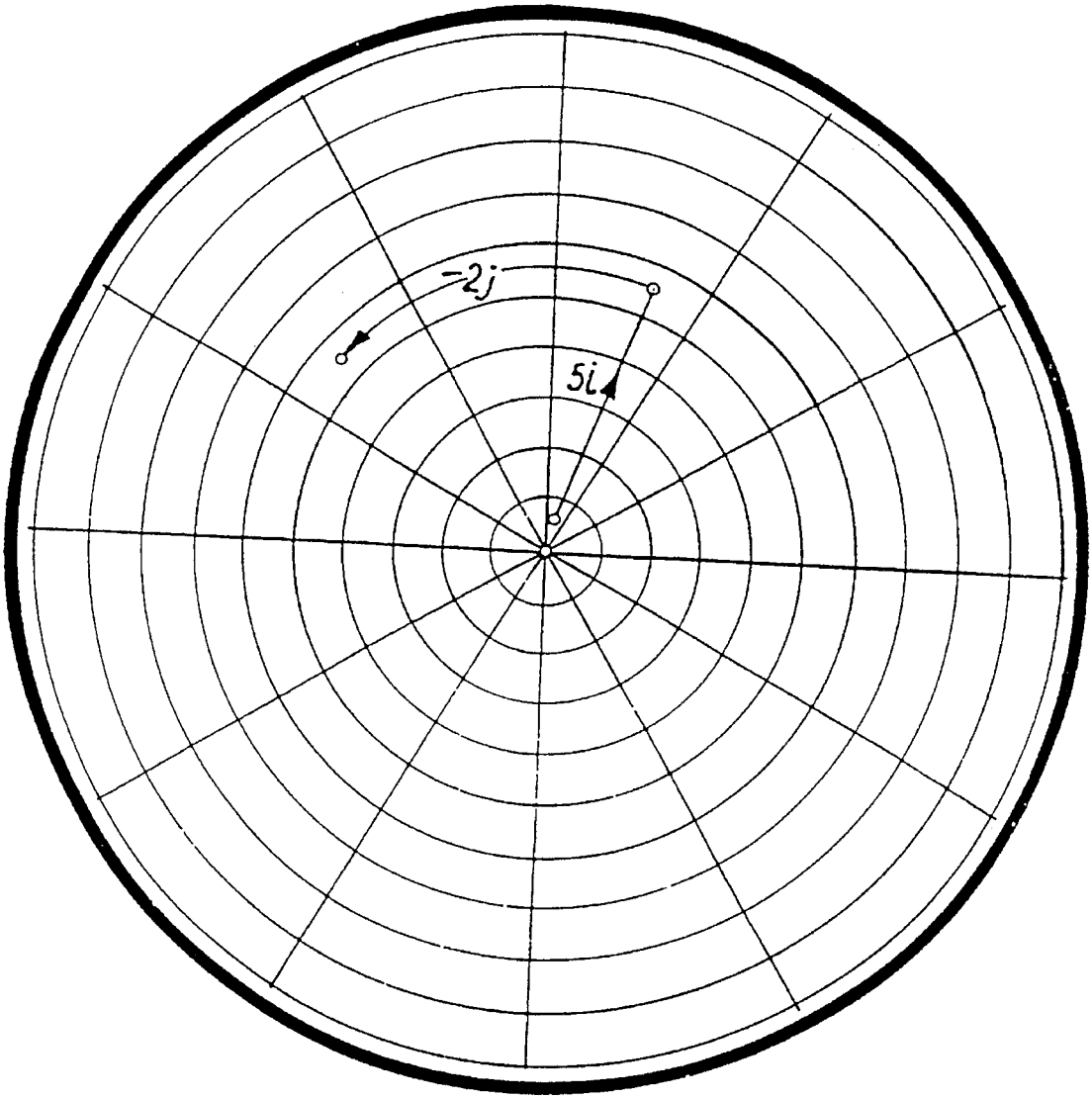
FIG. 25 is a plan view of another embodiment a playing surface.
Figure 26:
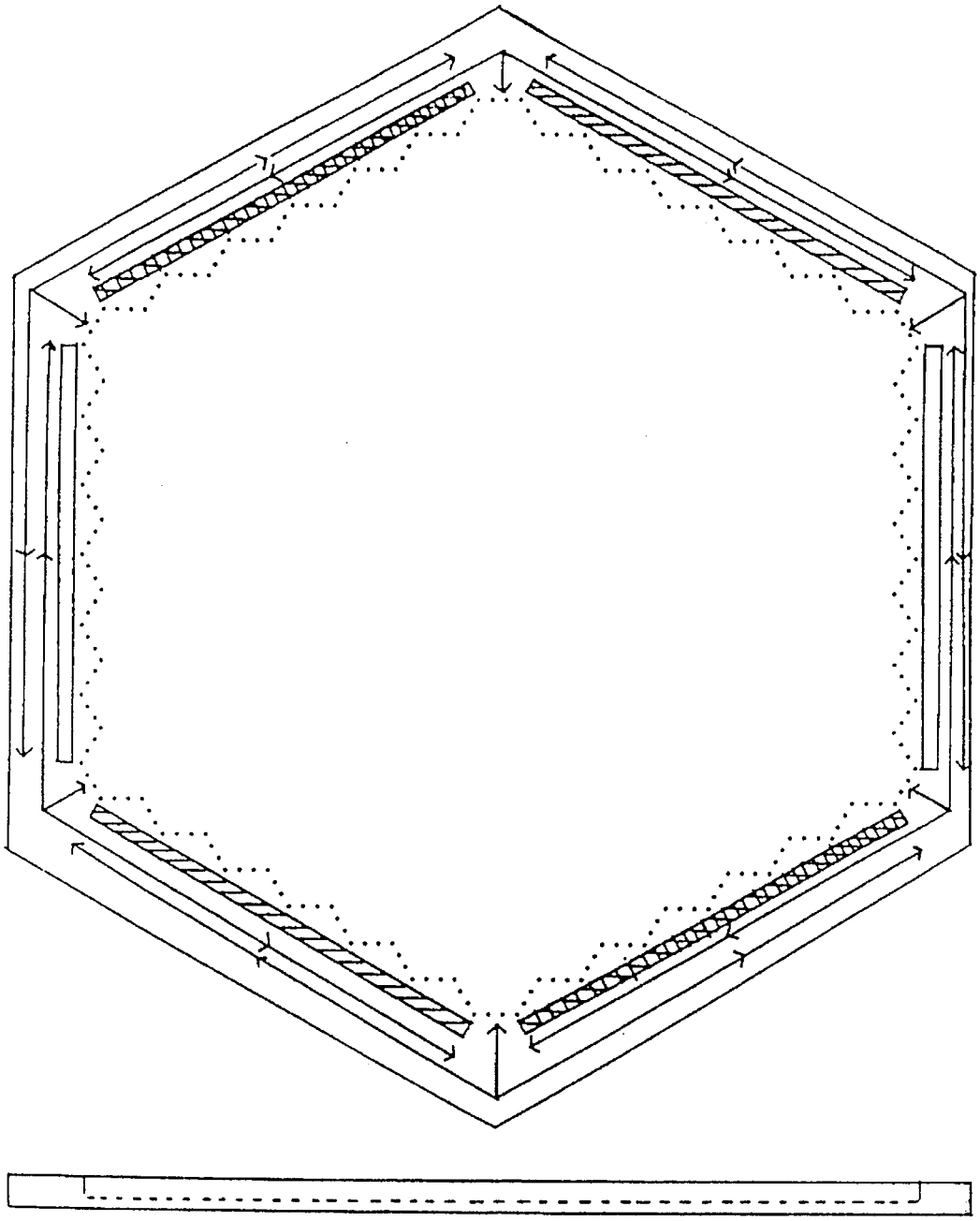
FIG. 26 is a plan view of an embodiment of a playing surface with a recess for pellucid inserts.
Figure 27:
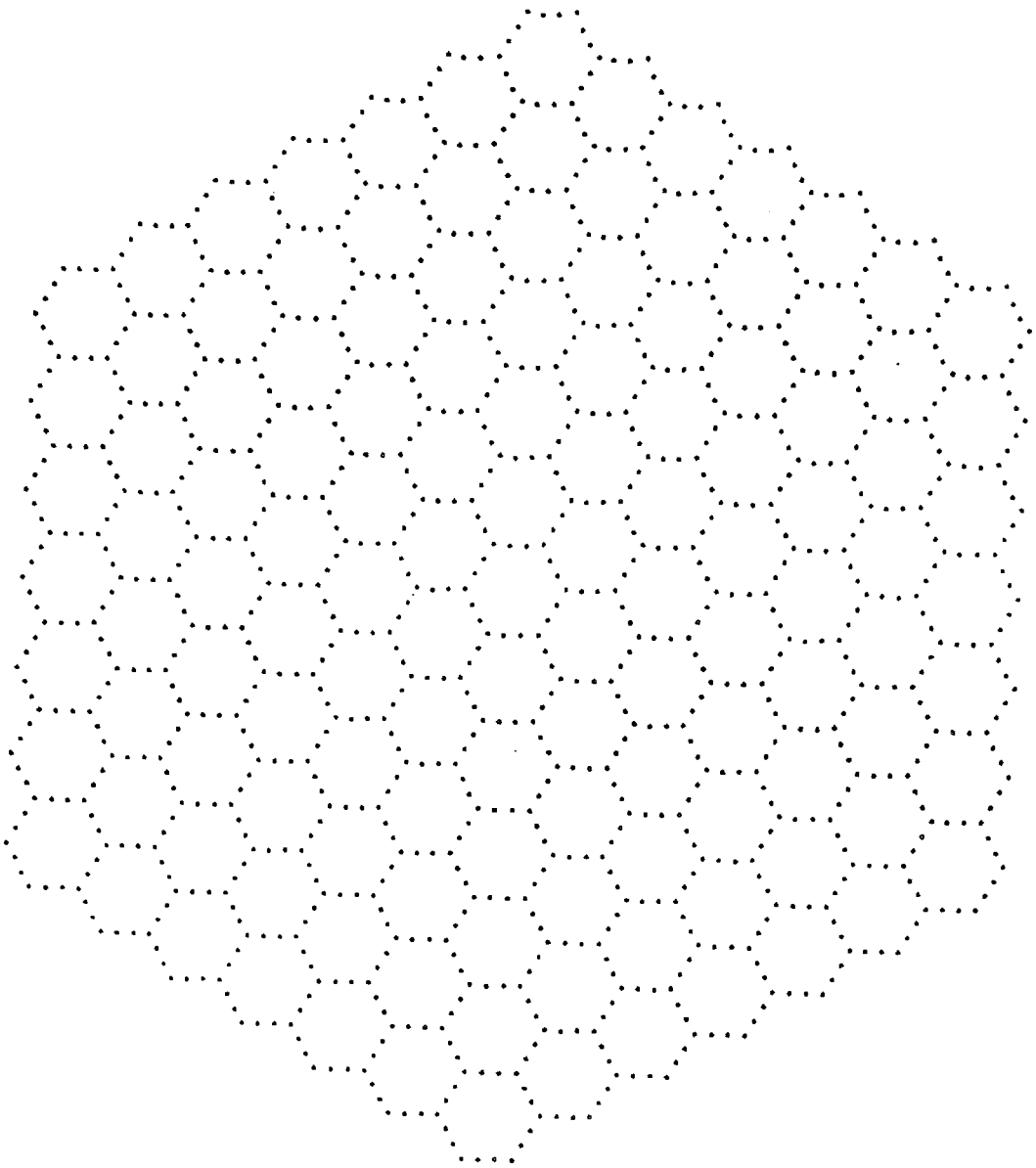
FIGS. 27 to 29 show views of the pellucid inserts for dropping into the playing surface of FIG. 26.
Figure 28:
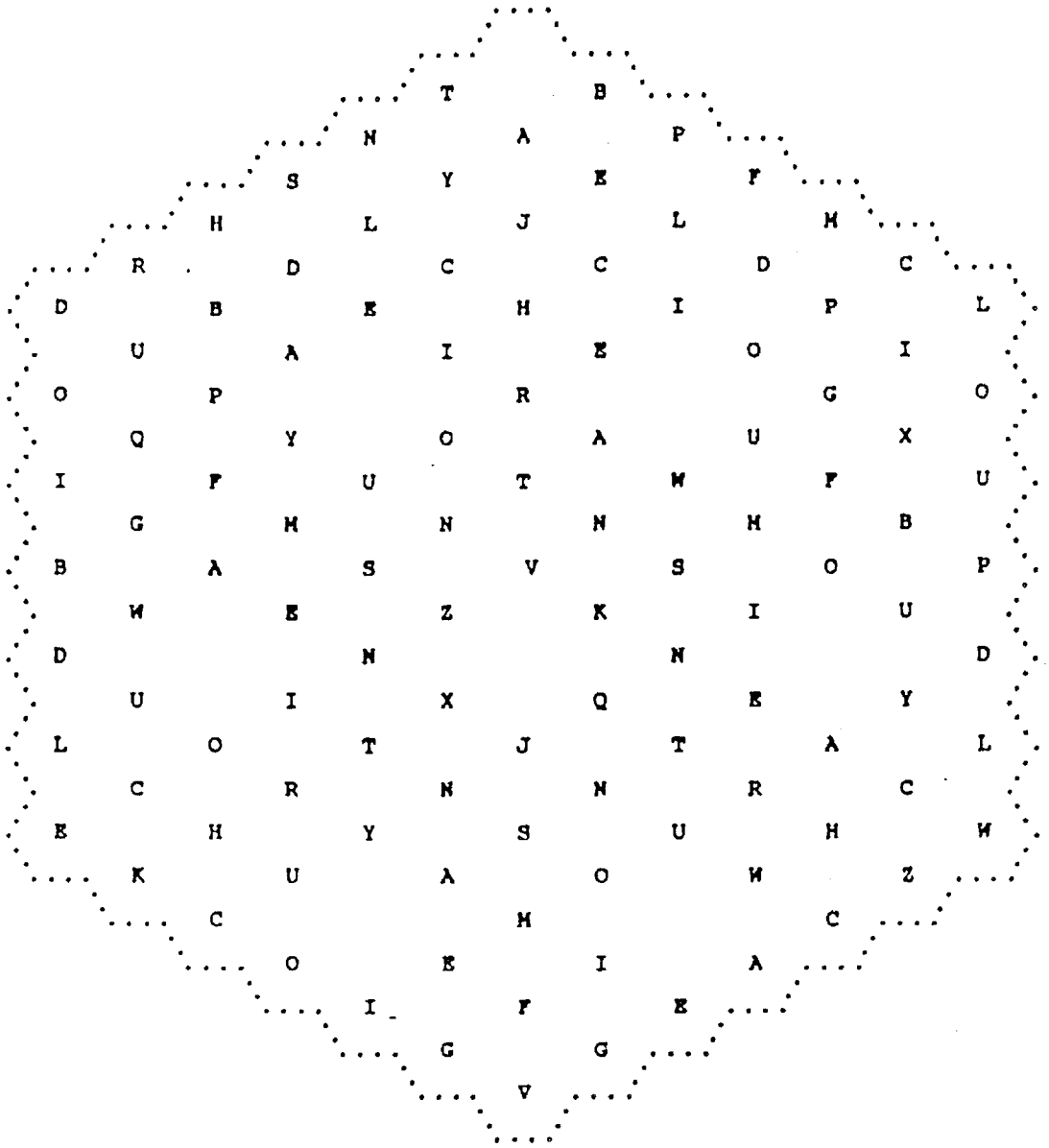
Figure 29:
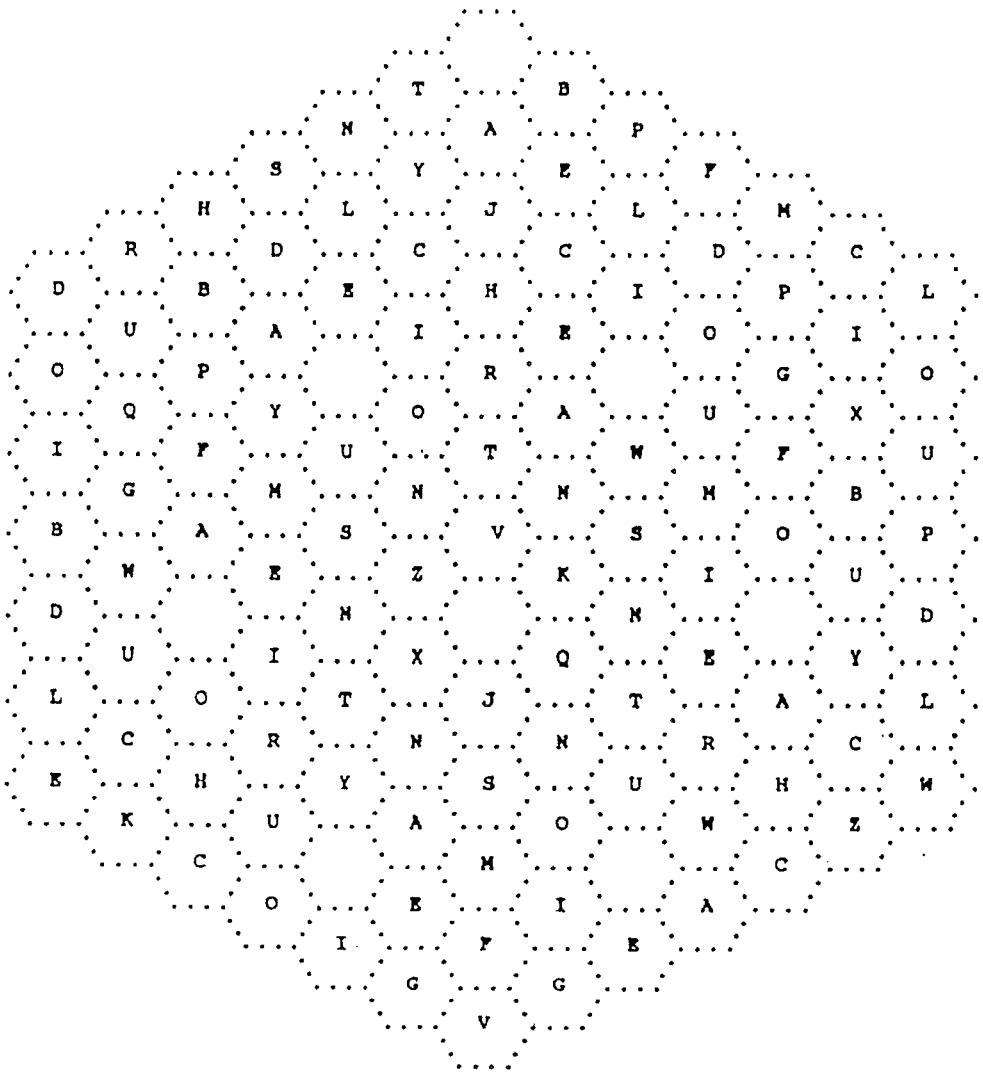
Figure 30:
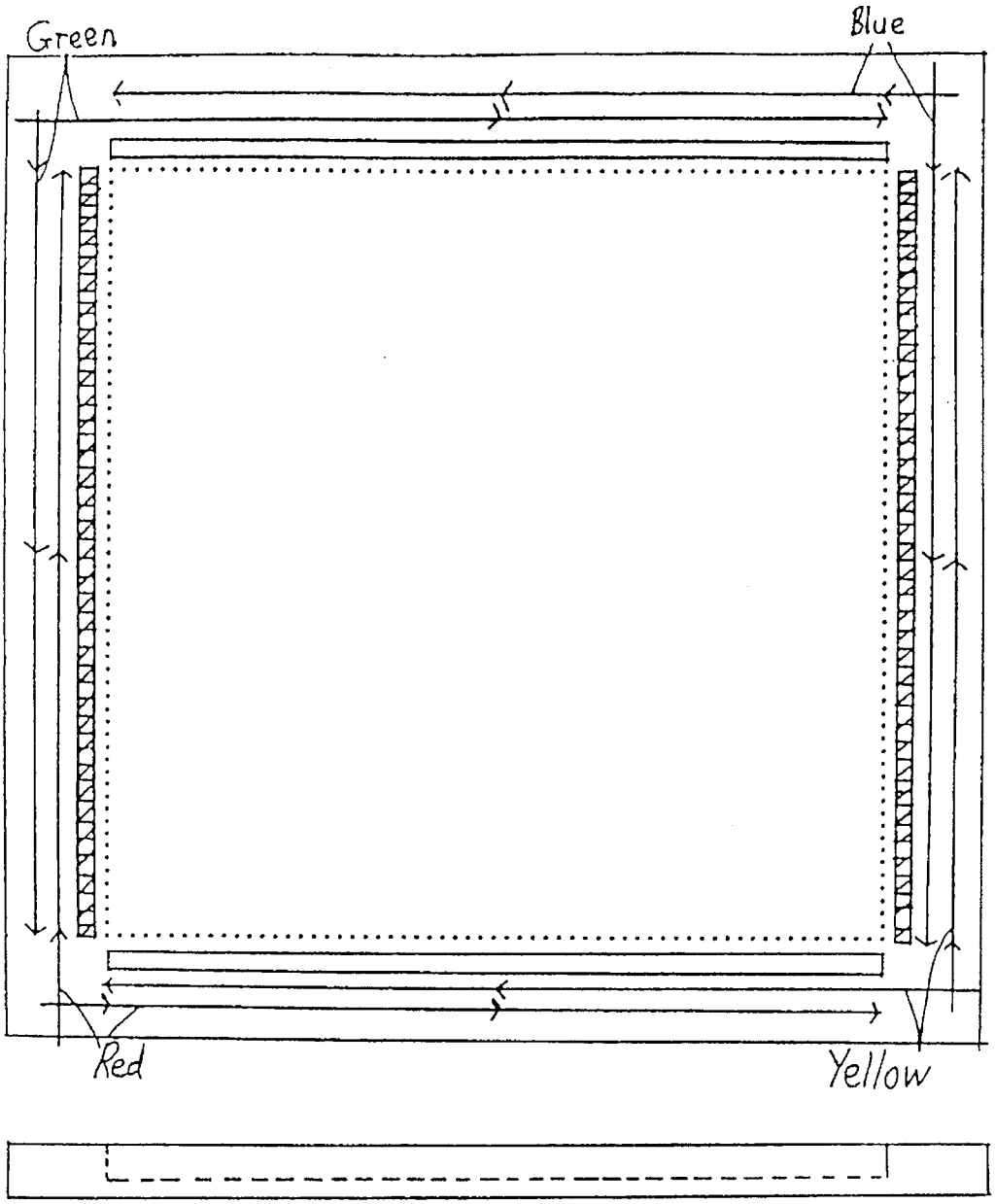
FIGS. 30 to 34 illustrate interchangeable sets of matrices and boards.
Figure 31:
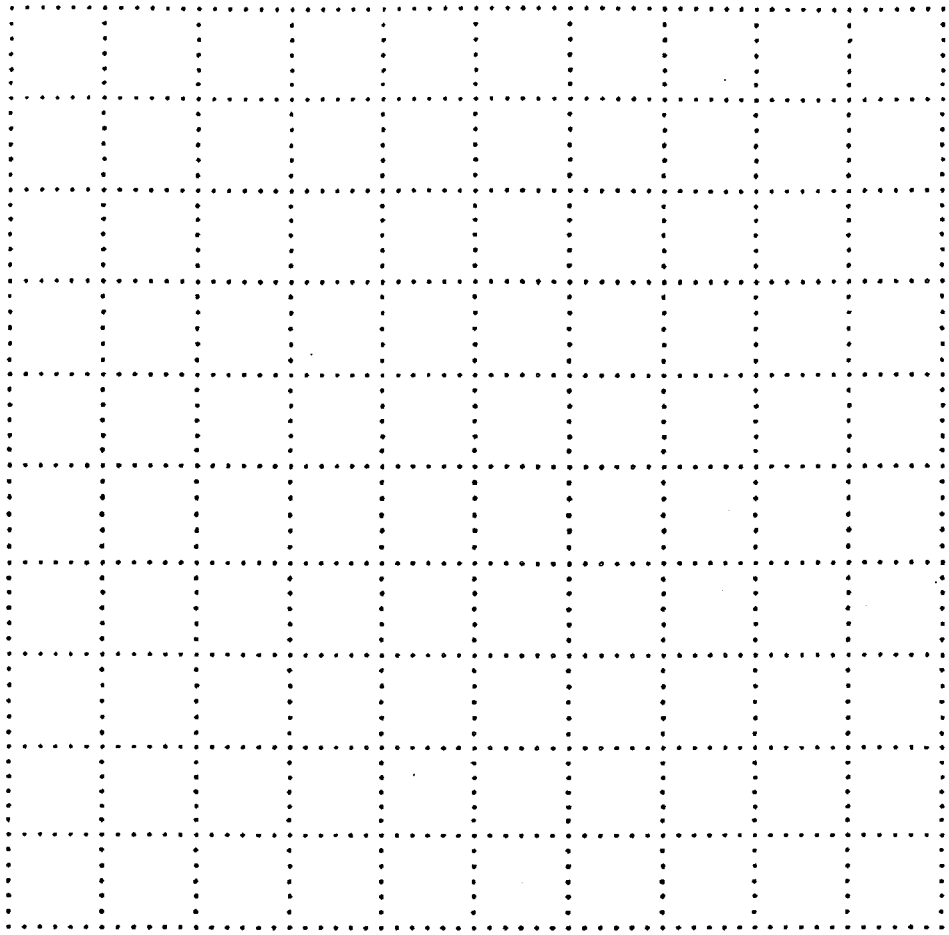
Figure 32:
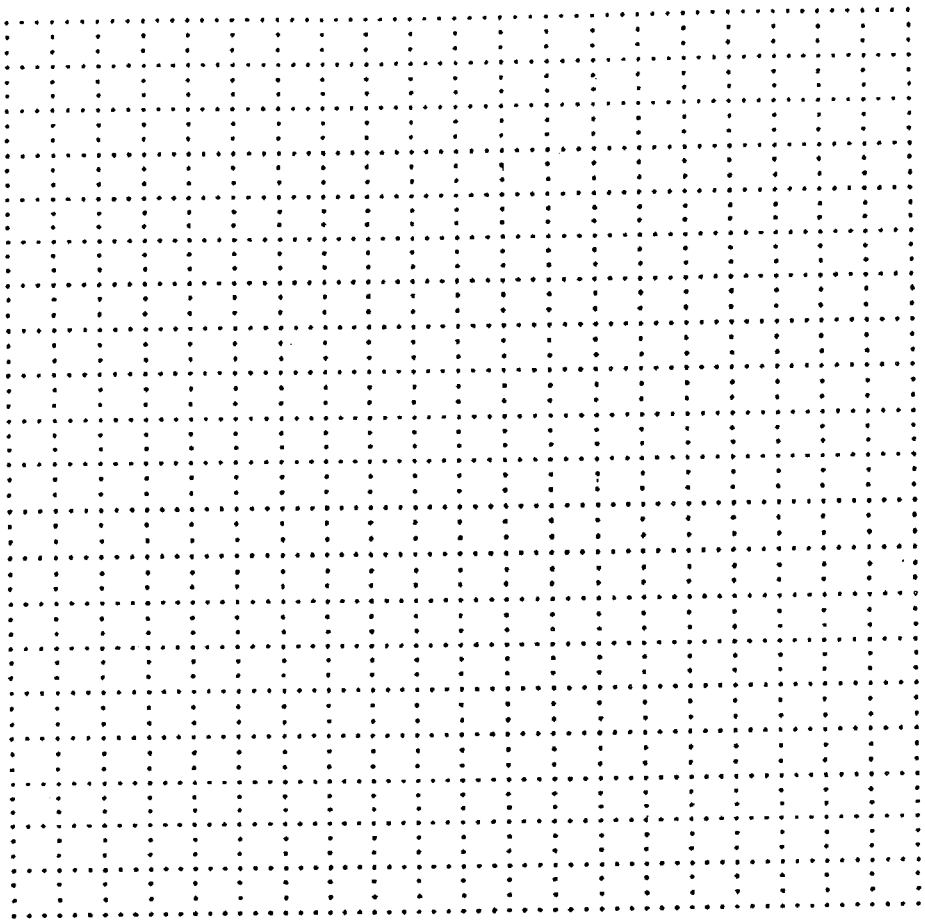
Figure 33:
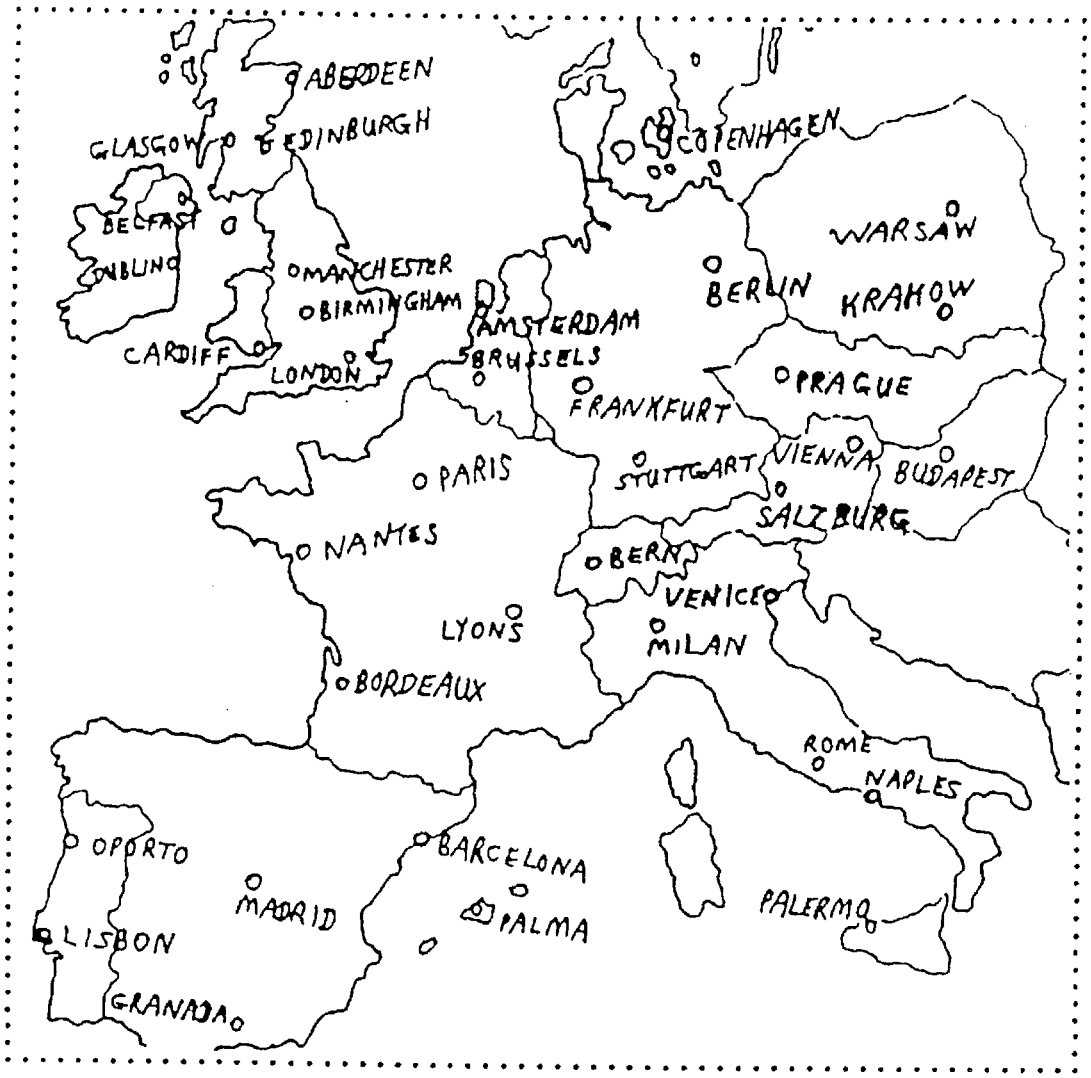
Figure 34:
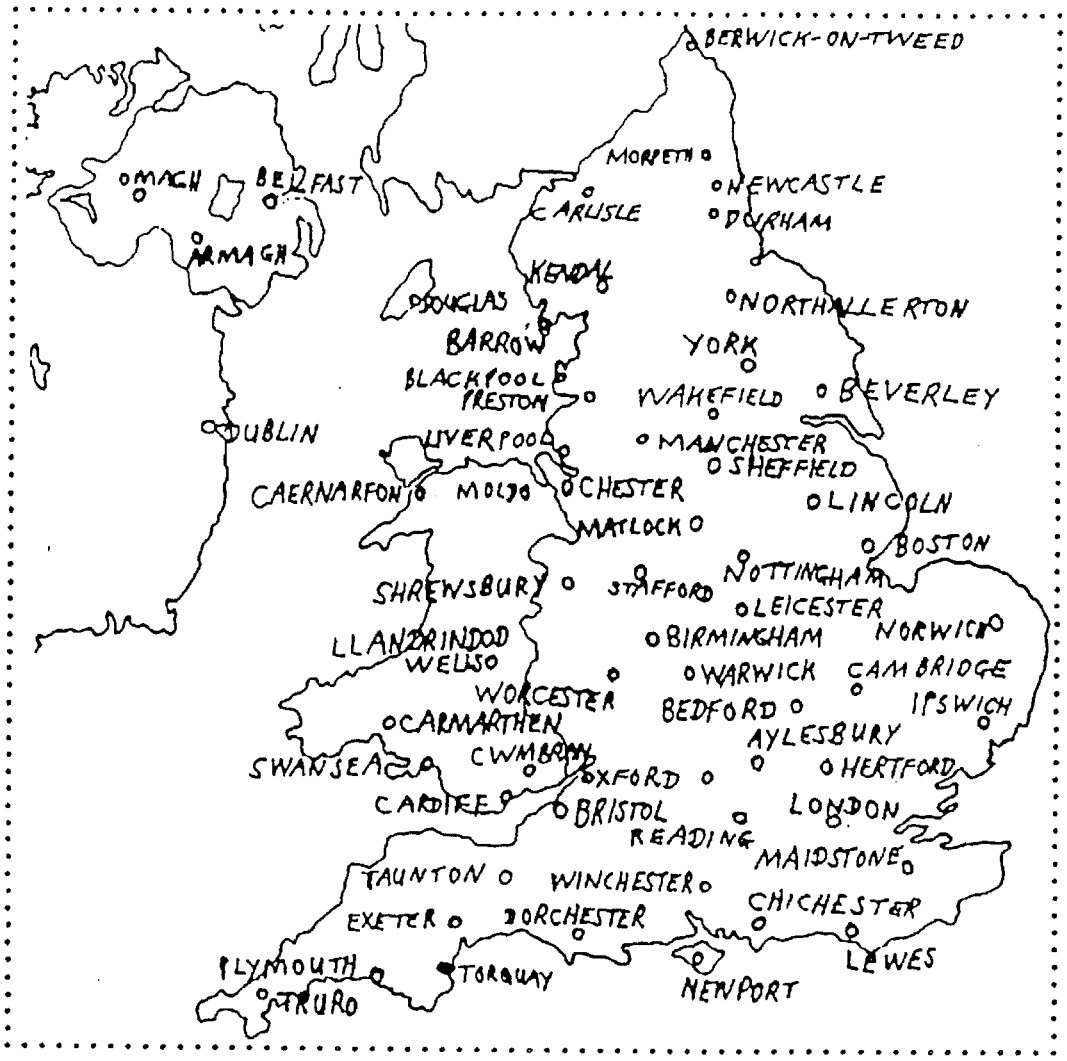
Figure 35:
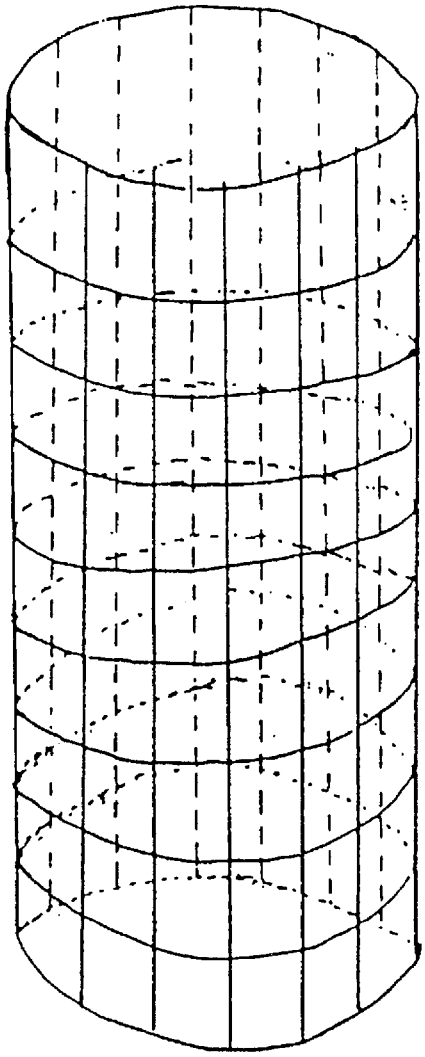
FIGS. 35 and 36 show a game board as a matrix on the outside and inside of a cylinder, respectively.
Figure 36:
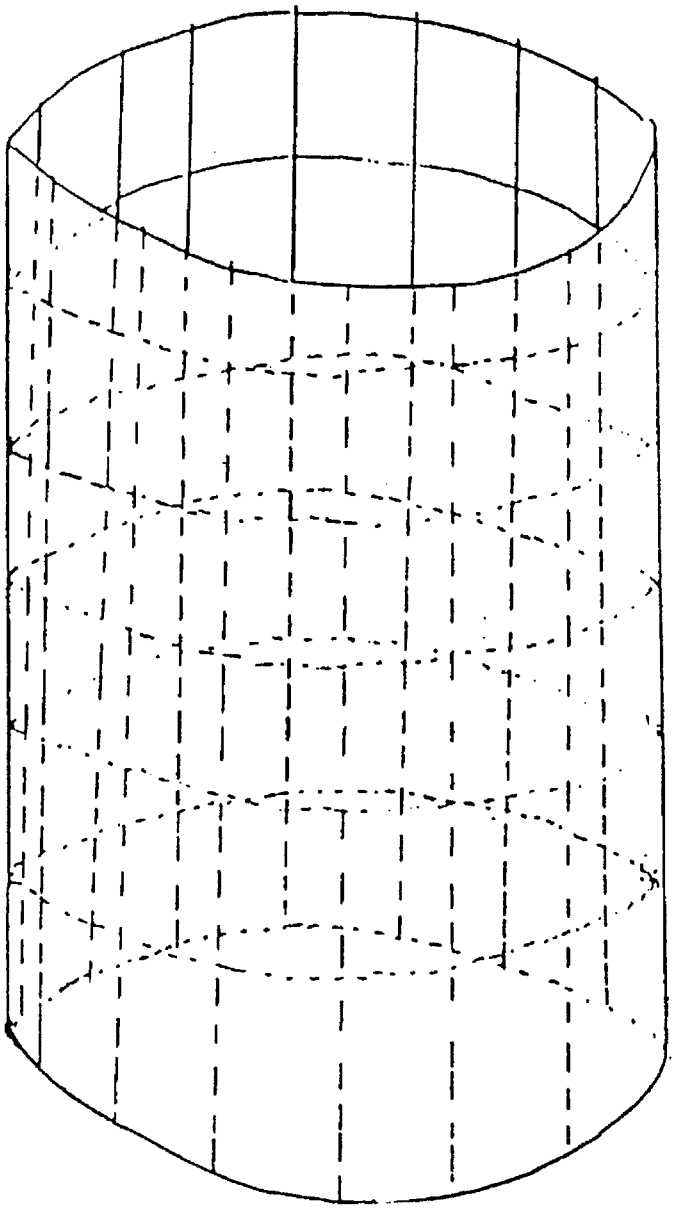
Figure 37:
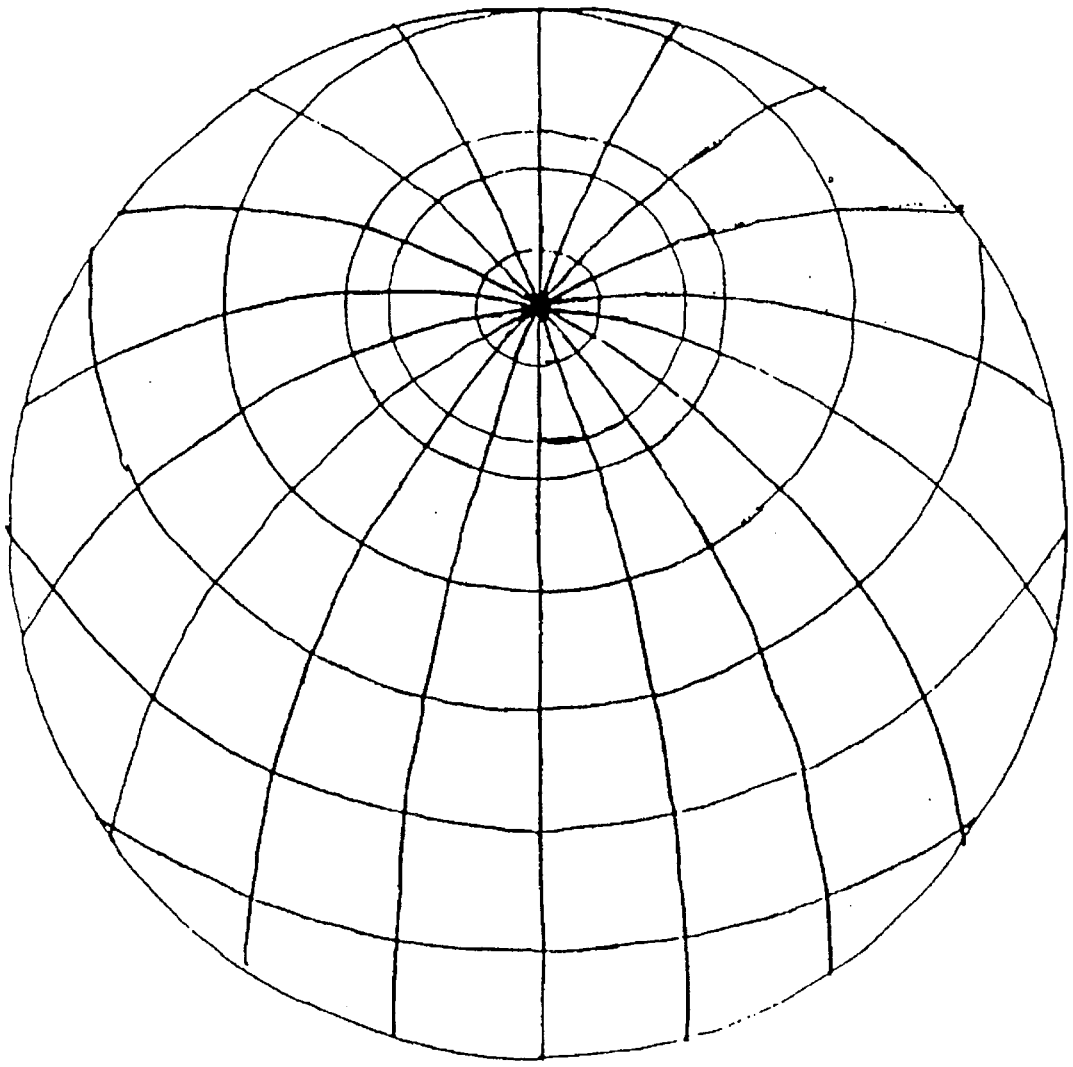
FIGS. 37 and 38 show how the matrix would appear on a game board such as a sphere or a terrestrial globe.
Figure 38:
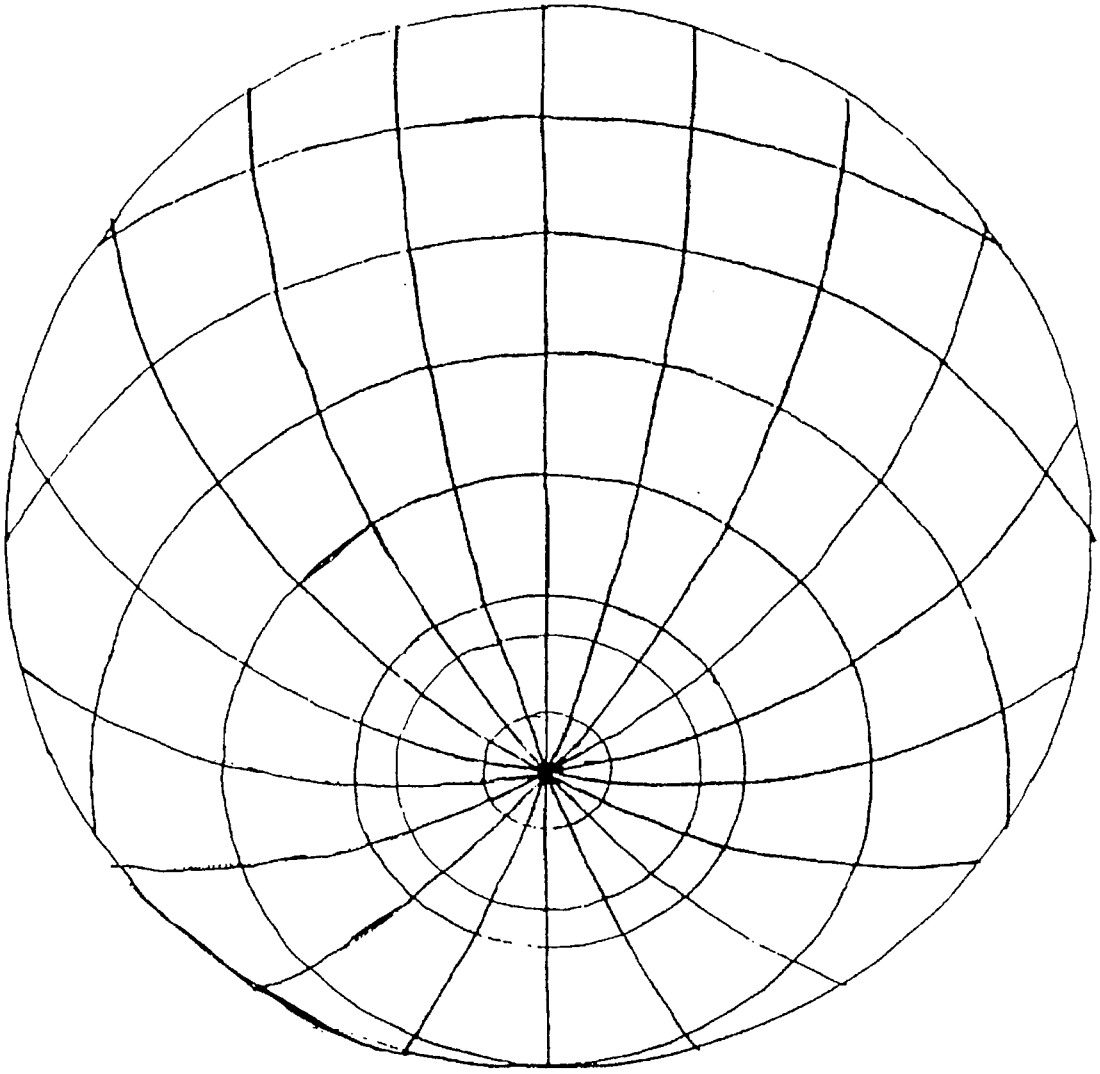

On a conventional games board the overall movement needs to be forwards, but on a games board providing for bidirectional movement there could be any one of the following fifteen types of movement:

(1) where there needs to be overall forward movement along each axis; the illustration in FIG. 24 showing the games board with a square matrix is an example of this;

(2) where there needs to be overall forward movement along one axis, but freedom to move in either direction along the other axis. An example of this would be the game where the board represents a stave of music, and the players have to visit the notes in sequence the first player to reach the last note being the winner;

(3) where there needs to be freedom to move in either direction along each axis. An example of this would be the game where the games board depicts a star map with a matrix over it. With this game there is provided a set of cards, each of which gives the name of, and information about, a different constellation. Each player takes a card at random, and puts his or her counter on the board on a star at one end of that constellation. Using domino dice, and using his or her skill and judgement, he or she then has to visit each of the other stars in sequence. Each player moves in turn The score for each constellation is the number of starts in it (this helps the players to remember how many there are in each constellation). When a player has visited all the stars in that constellation, he or she then takes another card at random, and visits the constellation named on it. The game ends when a player next completes his or her visit of a constellation after all the cards have been taken. The winner is the player who has the most points (for a part constellation, the score is the number of stars visited including the first).

The overall forward movement provided for in matrix dice and domino dice bearing the symbols *, +5, +4, +3, +2, +1, 0, −1, −2, −3, is ideal for situation (1), but it would need to be partially neutralised for situation (2), and fully neutralised for situation (3). It is to be appreciated that "neutralised" refers to the weighting of the type of dice used so as to provide an overall forward movement or a dice where there was no overall movement. The random selection of scores aforded by a matrix dice, while very suitable for situation (1), would not be very suitable for situations (2) and (3) where the game would be enhanced by introducing an element of skill. Situations (1) , (2) and (3) could all be met by having a set of domino dice bearing the symbols *, +5, +4, +3, +2, +1, 0, −1, −2, −3, −4, −5, as the domino dice bearing the symbols −4 and −5 against both backgrounds could be temporarily removed from the set for situation (1), and the domino dice bearing those symbols against the background control ling movement along the axis where overall forward movement is required, could be temporarily removed from the set for situation (2) . This is particularly the case if the symbols (the minus signs) for −4 and −5 appeared on the domino dice at 45° to those for −1, −2 and −3 and were for example made longer, as it is felt this would facilitate their identification and removal.

These general principles relating to the use of matrix dice and domino dice also apply mutatis mutandis to situations (4) to (15) which follow.

(4) where there is overall forward movement along one axis, but only forward movement along the other axis;

(5) where there needs to be overall forward movement along one axis, and overall backward movement along the other axis;

(6) where there is overall forward movement along one axis, but only backward movement along the other axis;

(7) where there is only forward movement along each axis;

(8) where there is only forward movement along one axis, but freedom to move in either direction along the other axis;

(9) where there is only forward movement along one axis, and overall backward movement along the other axis;

(10) where there is only forward movement along one axis, and only backward movement along the other axis;

(11) where there needs to be freedom to move in either direction along one axis, but overall backward movement along the other axis;

(12) where there is freedom to move in either direction along one axis, but only backward movement along the other axis;

(13) where there needs to be overall backward movement along each axis;

(14) where there is overall backward movement along one axis, and only backward movement along the other axis;

(15) where there is only backward movement along each axis.

Situations (4) to (15) inclusive could all be met by having a set of domino dice bearing the symbols * +5, +4, +3, +2, 0, −1, −2, −3, −4, −5, as the domino dice which are inappropriate for the type of movement which is required for a game could be temporarily removed from the set. So:

(a) where overall forward movement along an axis is required, the domino dice bearing the symbols −4 and −5 against the background controlling movement along that axis could be temporarily removed from the set;

(b) where only forward movement along an axis is required, the domino dice bearing the symbols −1, −2, −3, −4 and −5 against the background controlling movement along that axis could be temporarily removed from the set;

(c) where overall backward movement along an axis is required, the domino dice bearing the symbols +5 and +4 against the background controlling movement along that axis could be temporarily removed from the set;

(d) where only backward movement along an axis is required, the domino dice bearing the symbols +5, +4, +3, +2 and +1 against the background controlling movement along that axis could be temporarily removed from the set.

Three examples to illustrate which domino dice could be temporarily removed from the set on this basis in given situations are as follows:

In situation (8), the domino dice bearing the symbols −1, −2, −3, −4, and −5 against the background controlling movement along the axis where only forward movement is required could be temporarily removed from the set;

In situation (14), the domino dice bearing the symbols +5, +4, +3, +2 and +1 against the background controlling movement along the axis where only backward movement is required and the domino dice bearing the symbols +5 and +4 against the background controlling movement along the axis where overall backward movement is required could be temporarily removed from the set;

In situation (15), the domino dice bearing the symbols +5, +4, +3, +2 and +1 against both backgrounds could be temporarily removed from the set.

Another example of situation (3) where play would be enhanced by using a set of domino dice bearing the symbols *, +5, +4, +3, +2, +1, 0, −1, −2, −3, −4, −5, with each player using his or her skill and judgement, and where there is an educational element, would be the game where the games board is a matrix displaying letters of the alphabet, preferably set out at random with every letter of the alphabet appearing more than once. In one game on such a board, the object of the game is to visit each letter of the alphabet in alphabetical order. Any letter visited out of sequence does not count. Each player moves in turn. The player who completes the sequence first is the winner, the player who next completes the sequence comes second, and so on, until every player has visited every letter of the alphabet in sequence, at which point the game finishes.

In a variation of this game, a set of cards is provided, on each of which is printed a different word; each card could also have printed on it a definition of that word. Each player takes a card at random, and, using his or her skill and judgement, spells out the word printed on it by visiting on the games board all the letters in that word in the correct order. Each player moves in turn. The score for each complete word is the number of letters in that word, including the first. When a player has completed one word, he or she takes another card at random, and then spells out in a similar manner on the games board the word printed on that card. The game ends when a player next completes his or her spelling of a word in this manner after all the cards have been taken, and the winner is the player with the most points.

There could be different sets of cards with each set being graded according to the degree of difficulty of the words contained in it. Sets of such cards could be prepared for children of particular ages or in a particular year or years at school; they could also be prepared for adults.

Variations include a game with a set of cards where the words are spelt on the cards by means of a phonetic or training alphabet or otherwise phonetically, the object of the game being to spell out the words on the games board using conventional spelling; a game where each word is read out by another player or by someone who is not playing the game (such as, for example, a teacher or an observer), the object of the game being for each player to spell out correctly on the games board each word given to him or her without seeing it written down; and a game where each player has to discover what a word is from a clue or clues before spelling it out on the games board.

Instead of single words there could be groups of words, such as phrases or sentences, to be spelt out on the games board. The games board could have on it, as if each were a letter, a blank space and/or a hyphen (each of which would preferably appear more than once), in which case the rules of the game could require each player to visit a blank space between each word when spelling out a group of words, and/or to visit a hyphen in sequence when spelling out a hyphenated word. There could be one or more blanks in a well-known expression or proverb or quotation, with the object of the game being to spell out on the games board the missing word or words.

Such games where a games board is a matrix displaying letters of the alphabet are not limited to the English language, and could be used for another language or languages, subject to any appropriate variation in the letters displayed in the matrix; for example, a games board could have separate spaces for a letter without an accent and for the same letter with each available accent, so, for example, there could be separate spaces for each of E, E acute, E grave, and E circumflex, on a games board intended to be available for use with French words.

Another example of situation (3) where play would be enhanced by using a set of domino dice bearing the symbols *, +5, +4, +3, +2, +1, 0, −1, −2, −3, −4, −5, with each player using his or her skill and judgement, and where there is an educational element, would be the game where the games board depicts a map showing the conventional symbols for features on the ground, with an appropriate reference grid on the map. In one game using such a games board, the players would be in two or more teams, and each player would be given a list of features for his or her team to visit on the games board. In each such list, a feature might be identified by name, or by type (e.g. level crossing), or by map reference; information to be brought back could be in the first two cases the map reference, and in the third case the name of the feature, or the type of feature, which is at the particular map reference. Each player would move in turn, so if players A, B and C were in team one, players D, E and F were in team two, and players G, H and J were in team three, the players might move in the sequence, A, D, G, B, E, H, C, F, J. The first team to visit on the games board all the features on its list and bring back all the information required by that list would be the winner, and the game would then end. Such a game would not only be of educational value for teaching map reading; it would also be of value in training people in team work, since it would take much longer for the members of a team to complete the game if they acted individually than if they worked together as a team and allocated different items on their list to different members of their team.

The matrix need not necessarily be an integral part of the games board; it could be on a separate sheet, and either it, or the games board, or both, could be pellucid, so that one could be placed over the other, or inserted in the other, so as to produce a board, easily viewed whether by reflected light or transmitted light. This could be useful in games such as the aforementioned game involving a stave of music or the map of a galaxy, so that the music or the star map could be changed.

For such a method of superimposition or assembly to be possible it is not necessary that the matrix, the games board, and any insert there may be, should be flat; they could, for example, be conical or cylindrical or hemispherical, or even spherical; if they are spherical, one or more of them could each consist of two hemispheres.

It is not necessary that any images of the games board or the matrix or both should be the same size or scale or shape (whether in two dimensions or three) or have the same number of dimensions or be in the same proportions as each other or the playing surface, since such images could appear on inserts and/or on slides and/or on other devices such as, for example, meshes and/or cut-outs (which inserts and/or slides and/or devices need not necessarily be flat), with provision being made for the images depicted thereon to be projected on to the playing surface (and such of the games board and the matrix as is not projected) whether from the back or from the front and whether from the inside or from the outside and with appropriate enlargement or reduction and any appropriate change in perspective or rectification of distortion. It will be appreciated that, for example, if a flat slide is to be projected on to a curved surface it will be necessary to make due allowance for such curvature either when the slide is prepared or when it is projected.

By changing the board (or insert), or even the matrix, or slides and/or other devices, the game could be changed so as to produce a modified game or even a different game. It is even possible to have interchangeable sets of matrices and boards (or inserts and/or slides and/or other devices). For example, the star map used in one game could be changed for a terrestrial map or town plan, with each player embarking on a series of tours, and the cards listing the tours stating individually the number of points awarded for that tour, and also for parts if incomplete at the end of the game. As another example, a terrestrial globe used in one game could be changed to a lunar globe or a celestial globe.

Variation may be made to the above embodiments without departing from the scope of the invention. For example variation may include arranging for:

A random choice of score; or a random choice of axis; or a random choice of forward or backward movement.

Weighting of symbols to ensure overall movement in one direction or sense; provided there is an equal probability of each face being thrown. Alternatively a dice may be weighted.

If a game required the use of a matrix dice on which the symbols were not weighted to ensure overall movement in any direction, a matrix dice could be used on which each +5 (for example) was replaced by −4; and if a game required the use of a matrix dice on which the symbols were weighted to ensure overall forward movement along one axis only, such a matrix dice could be used on which only the +5 for the other axis was replaced by −4.

Depending on the individual board game:

(a) the variables may be selected either (A) at random, for example by using a matrix dice, or by using domino dice drawn individually out of an opaque bag, or (B) by using the player's skill and judgement, for example by the player deciding which to play of the (say) ten domino dice which he or she has already drawn out of an opaque bag, and, in the case of process (B), after playing each domino dice, would draw a replacement domino dice out of the opaque bag, so as to bring the number of domino dice he or she has back up to ten; selection by process (B) would, for example, be particularly suitable for the games already described where one games board depicts a star map, another games board is a matrix displaying letters of the alphabet, and another is a map showing conventional symbols for features on the ground, and also for the games played on a terrestrial or lunar globe; if the rules of the game so provide, a player may change all or any of his or her domino dice on missing a turn, and would do so by drawing from the opaque bag the required number of domino dice and putting back in the opaque bag the domino dice which he or she has discarded;

(b) provision may be made for different players to start and finish in different places on the board and/or for the board to be the right way up for each player whichever edge is facing him or her, even though the player is free to use the whole of the playing area of the board.

(c) a player may choose the axis at random, for example by using a matrix dice, or may move along both axes simultaneously, for example by using domino dice;

(d) play could be forwards only along each axis, in which case a twelve-sided matrix dice could be used bearing the symbols *, +5, +4, +3, +2, +1, once against a light background, and once against a dark background.

(e) play could be in a forward direction only along one axis, with either overall forward movement or freedom of movement in either direction along the other axis.

It is not necessary that domino dice should be the same size and thickness as conventional dominoes; they could take the form of playing cards, in which case:

(1) instead of a player drawing (say) ten domino dice from an opaque bag, the appropriate number of domino dice could be dealt to him or her from a shuffled pack; alternatively and/or subsequently the shuffled pack could be laid face down on a table and each player in turn then draws the required number of domino dice from the top of it;

(2) the "available stack" means such part of the pack of domino dice as is available for the time being for domino dice to be dealt to, or drawn by, players;

(3) if the rules of the game so provide, a player may change all or any of his or her domino dice on missing a turn, and would do so by drawing from the available stack the required number of domino dice and putting back in it the number of domino dice which he or she has discarded, at which point the available stack would be shuffled again and placed face down on the table;

(4) the used domino dice would be kept separate from the available stack until either the available stack is exhausted or a player changes one or more domino dice; in the former situation (and in the latter situation also if the rules of the game so provide) all the domino dice which are neither in play nor in the possession of players would be shuffled and placed face down on the table as the available stack.

The embodiment shown in FIG. 24 may be used with two conventional six-sided dice, each one a different colour, being used simultaneously. This results in movement along both axes simultaneously in a forward direction only. If it were desired to have random choice of score and axis, (but not direction) without using a matrix dice, this could be achieved by using a conventional six-sided dice and a blank cube having three light sides and three dark sides or a coin with one face dark and the other face light.

If it were desired to have random choice of direction also, with overall forward movement, this could be achieved (although in a different way from a matrix dice) by using one conventional six-sided dice and also a cube which had no numbers marked on it, but had three light sides and three dark sides, with two light sides and two dark sides each being marked with a plus sign, and the third light side and the third dark side each being marked with a minus sign.

If it were desired to have random choice of score and axis, but with random choice of direction and overall forward movement along one axis, and only forward movement along the other axis, this could be achieved by using a conventional six-sided dice and a cube, which had no numbers marked on it, on which cube the first and second sides were each marked with a plus sign, the third side was marked with a minus sign, and the fourth, fifth and sixth sides were all blank; the first, second and third sides of the cube would all be light, and the fourt, fifth and sixth sides of the cube would all be dark, or vice versa.

If it were desired to have random choice of score and axis, but with random choice of direction and overall forward movement along one axis, and freedom of movement along the other axis, this could be achieved by using a conventional six-sided dice and an octahedron, which had no numbers marked on it, on which octahedron the first, second, third, fifth and sixth sides were each marked with a plus sign; and the fourth, seventh and eighth sides were all marked with a minus sign; the first, second, third and fourth sides of the octahedron would all be light, and the fifth, sixth, seventh and eighth sides of the octahedron would all be dark, or vice versa. Alternatively, in place of an octahedron a dodecahedron could be used which had no numbers marked on it and on which dodecahedron the first, second, third, fourth, seventh, eighth and ninth sides were all marked with a plus sign, and the fifth, sixth, tenth, eleventh and twelfth sides were all marked with a minus sign; the first, second, third, fourth, filth and sixth sides of the dodecahedron would all be light, and the seventh, eighth, ninth, tenth, eleventh and twelfth sides of the dodecahedron would all be dark, or vice versa.

If it were desired to have movement along both axes simultaneously, and to have random choice of score and direction with overall forward movement along each axis, this could be achieved (although in a different way from domino dice) by using simultaneously:

(A) one conventional six-sided dice, of light colour, and also a cube in the same light colour which had no numbers marked on it but had four sides each marked with a plus sign and the other two sides each marked with a minus sign; used as a pair these would indicate movement along one axis; and (B) one conventional six-sided dice, of dark colour, and also a cube in the same dark colour which had no numbers marked on it but had four sides each marked with a plus sign and the other two sides each marked with a minus sign; used as a pair these would indicate movement along the other axis.

If it were desired to have movement along both axes simultaneously, with random choice of score along each axis, with random choice of direction and overall forward movement along one axis only, with only forward movement along the other axis, this could be achieved (although in a different way from domino dice) by using simultaneously:

(C) one conventional six-sided dice, of light colour, and also a cube in the same light colour which had no numbers marked on it but had four sides each marked with a plus sign and the other two sides each marked with a minus sign; used as a pair these would indicate movement along one axis; and (D) one six-sided conventional dice, of dark colour, which by itself would indicate movement along the other axis. Alternatively the conventional six-sided dice and the cube mentioned in sub-paragraph (C) of this paragraph could both be dark, and the conventional six-sided dice mentioned in sub-paragraph (D) of this paragraph could be light.

It will be appreciated that, in addition to the examples which have already been given, there are many other ways in which such unnumbered cubes or octahedra or dodecahedra may be marked and used with one or more conventional six-sided dice so as to achieve the type of movement required on a bidirectional games board where random scores are desired.

As a further alternative to a matrix dice and to domino dice, all or part of a pack of conventional playing cards could be used; these would be suitable, since there are two red suits and two black suits of playing cards, and there two directions of travel along each of two axes on a bidirectional games board, so a different suit could be assigned to each such combination. Preferably the two red suits would control movement along one axis, with one red suit controlling forward movement, and the other red suit controlling backward movement, and the two black suits would control movement along the other axis, with one black suit controlling forward movement, and the other black suit controlling backward movement. This could be done as follows:

hearts: forwards along the x-axis;

diamonds: backward along the x-axis;

spades: forwards along the y-axis;

clubs: backwards along the y-axis.

One way in which the embodiment of playing surface shown in FIG. 24 could be adapted to this is as follows (on the hypothesis that FIG. 24 is the correct way up and is vertical):

(1) the green and red horizontal directional arrows would each display at intervals a heart with a directional arrow pointing to the right, and a diamond within a subsidiary directional arrow pointing to the left (that is, backwards);

(2) the blue and yellow horizontal directional arrows would each display at intervals a heart with a directional arrow pointing to the left, and a diamond within a subsidiary directional arrow pointing to the right (that is, backwards);

(3) the red and yellow vertical directional arrows would each display at intervals a spade with a directional arrow pointing upwards, and a club within a subsidiary directional arrow pointing downwards (that is, backwards);

(4) the green and blue vertical directional arrows would each display a spade with a directional arrow pointing downwards, and a club within a subsidiary directional arrow pointing upwards (that is, backwards).

It is not only the number cards from conventional playing cards which could be used; court cards could also be used. In the examples which now follow, the first alternatives could apply where all the number cards from ace to ten inclusive are used, and the second alternatives, which appear in brackets, could apply where the only number cards which are used are those from ace to six inclusive.

(1) the King of Hearts and the King of Spades could each represent a variable movement of between +10 and +6 inclusive (or between +6 and +4 inclusive) along his own axis;

(2) the Queen of Hearts and the Queen of Spades could each represent a variable movement of between +5 and +1 inclusive (or between +3 and +1 inclusive) along her own axis;

(3) each Jack, or Knave, could represent a movement of zero along his own axis;

(4) the Queen of Diamonds and the Queen of Clubs could each represent a variable movement of between −1 and −5 inclusive (or between −1 and −3 inclusive) along her own axis;

(5) the King of Diamonds and the King of Clubs could each represent a variable movement of between −6 and −10 inclusive (or between −4 and −6 inclusive) along his own axis;

(6) the Joker, if used, could represent a variable movement of between +10 and −10 inclusive (or between +6 and −6 inclusive) along either axis.

If all or any court cards were used, different scores from those mentioned above could be allocated to them; this would depend on the rules of the game.

Just as the symbols on matrix dice can be weighted, and just as a set of domino dice bearing the symbols *, +5, +4, +3, +2, +1, 0, −1, −2, −3, −4, −5, can be weighted by temporarily removing from the set the domino dice bearing certain symbols against either or both backgrounds, in order to be suitable for an individual game, so there could be removed from a set of conventional playing cards any number cards and/or court cards which are inappropriate for an individual For a game requiring random scores with random choice of direction and axis, the players could move in turn, drawing one card from a shuffled pack of conventional playing cards placed face down on a table, and playing that card.

For a game requiring movement along both axes simultaneously, but with random scores and random choice of direction, a pack of conventional playing cards (preferably omitting the Joker) could be divided into two stacks, that is, one to control movement along one axis, and the other to control movement along the other axis. Preferably one stack would contain only cards from red suits, and the other stack would contain only cards from black suits. Each stack would be shuffled and placed face down on a table. Each player would move in turn, drawing one card from each stack and playing them both.

An element of skill and judgment could be introduced by providing for the players each to draw or to be dealt a predetermined number of cards from the stack (or each stack, as the case may be) and to play them in the order in which he or she considered best; after playing a card or pair of cards, a player would then draw another card from the stack (or each stack, as the case may be). As previously described in relation to domino dice, if the rules of the game so provided, a player could replace any or all of his or her cards on missing a turn.

A bidirectional game where conventional playing cards are used is not necessarily limited to the whole or part of one pack of such cards; the whole or parts of more than one pack of cards could be used, and it might be thought that to do so in some games would enhance play. It is not even necessary that all the same cards should be used from every such pack, since any weighting which might be required for a game might be achieved by, for example, using the whole of one pack of cards and part of another pack.

By allowing for bidirectional movement, there could be a multiplicity of embodiments of the games boarad, including the following, and, if and where appropriate, reference information such as, for example, degrees of latitude and longitude, or a musical clef, or measurements of whatever kind, could appear along the axes or elsewhere:

a graph;

a sales chart;

a pie chart;

a map;

a town plan;

a star map;

a map superimposed on a model of the area which it represents;

a matrix displaying letters of the alphabet;

a matrix displaying numbers;

a matrix with mathematical shapes on it;

a maze;

a solid, such as a cone or cylinder or sphere;

a terrestrial globe.

It has already been said that the differently coloured backgrounds on the dice may denote different players or movement along different axes. They may also denote differences which result when a player's token or counter is on or remains on or is moved to a particular square or squares on a games board or when a card containing instructions is used or drawn. For example, a game might concern lifestyles in different countries, with Light denoting one country and Dark denoting another country; a player whose token or counter is moved to or remains on a particular square as a result of the dice showing a certain numerical score would have to answer a question on the first country if the relevant face of the dice were Light, but on the second country if the relevant face of the dice were Dark, and the player who answered the most questions correctly would be the winner. This principle could be used in a game concerned with translation of words and/or expressions into and/or from a foreign language or languages. Different squares on the board could indicate different categories of words and/or expressions, with sets of cards containing questions for each category. So, for example, a player whose token or counter is moved to a particular square which specifies household objects might be asked to translate a word in that category from French to English if the relevant face of the dice is Light, or from English to French if the face of the dice is Dark. A variation of this game might require translation of a word in the relevant category from English to German if the relevant face of the dice is Light, but from English to French if the relevant face of the dice is Dark.

Many other variations are possible. For example, Light might pertain to matters relating to the twentieth century, and Dark might pertain to matters relating to the nineteenth century, or Light might require one action and Dark another, or there might be different numbers of points awarded for reaching a square depending on whether the relevant face of the dice was Light or Dark. The use of different backgrounds therefore allows two or more compatible but different games, or two or more variations of a game, to be played on the same board at the same time by the same players. The board, or one or more conversion tables, or one or more overlays, used with the board, would indicate the differences which were made by the different backgrounds. Using a polyhedral dice the changes from one to the other would be at random, but it would be possible to introduce an element of skill into such changes, and so enhancing the overall game by having a set of cards or tiles similar to domino dice but in which each card or tile would show one face only. These are referred to as single tile dice. Preferably each single tile dice would appear the same number of times and (it were considered desirable in view of the small number of combinations possible, as might be the case if there were ten symbols and two backgrounds and therefore only twenty combinations possible) more than once. Each player would take a number of single tile dice at random (say from a stack which had been shuffled and placed face down on the table) and then play them in such order as he or she thought fit, using his or her skill and judgement, and replacing them individually from the stack as and when used. The used single tile dice would be shuffled and used again when the stack was depleted. If so desired, or if the rules of the game so provided, each single tile dice could be drawn individually at random lot each move.

Dice, whether polyhedral dice, or single tile dice, or domino dice, need not be limited to two sets of symbols with different backgrounds, and there could be a greater number of sets of symbols each with a different background; there might, for example, be three or four.

Single tile dice could also be used as a type of playing cards, and many different games would be possible with them. For example, if two sets of single tile dice were used, they could be shuffled and placed individually face down on a table, the object being to pick out matching pairs. The player who picked out the most matching pairs would be the winner.

If a dice has four sets of symbols, and these are differentiated by backgrounds A, B, C, and D respectively, backgrounds A and B could control movement along the x axis, backgrounds C and D could control movement along the y axis, backgrounds A and C could control variation 1 of the game (or game 1) and backgrounds B and D could control variation 2 of the game (or game 2).

Depending on the game, each set of numbers need not necessarily be identical.

Four sets of symbols with different backgrounds could also denote different players or movement along different axes of reference, thus allowing diagonal movements. For example, on a square matrix, background A could control movement along the x axis, background B could control movement along the y axis, background C could control movement along an axis which bisects the right angle at the intersection of the x and y axes, and background D could control movement along an axis perpendicular to that controlled by background C.

A games board could have on it a matrix consisting, for example, of hexagons, with each of three axes running perpendicularly through the respective parallel edges of the hexagons. Dice used for this purpose would need to have three sets of symbols, with each set having a different background. These backgrounds will be referred to as Light, Intermediate, and Dark.

With three backgrounds, Dark could denote movement along the x axis, Light could denote movement along the y axis, and Intermediate could denote movement above (and/or even below, if the games board were on a stand or suspended) the games board. Thus movement in three dimensions would be possible.

One way of accomplishing vertical movement (assuming that the games board is horizontal) would be by having a games board with a hole in each space on its surface (each hole being the same) and by having as a counter or token for each player a differently coloured retractable column which would fit in the holes in the games board and could be inserted and retracted as required, with the columns being click-stopped for every vertical unit. The columns could be made of such a length as to allow them to be inserted or extended only so far as the rules of the game or games for which the columns are intended allow. To facilitate correct insertion in another hole when a move is made, there could be symbols marked on the columns, or a scale could be provided which would enable players to verify how far any particular column had been inserted or extended. Additionally or alternatively, each player could have two columns, possibly with a distinguishing feature or features on them, and these two columns would be used alternatively, so that when a move was made the player would leave his or her column in place on or in the games board until he or she had correctly positioned the other column in the position reached on that move, whereupon the first column would be retracted completely from the games board; this would facilitate the correct positioning of the second column.

Another way of accomplishing vertical movement would be by having columns of variable length clipped or held by magnetism or gravity on to the games board; such columns could be made up of small blocks each one unit thick similarly held in place. Again a scale could be used to verify the height or depth of each column.

If the games board were vertical, such click-stopped columns could be used to provide horizontal movement.

The rules of the game might require, for example, that the limit on movement upwards was 20 units on a 20 ×20 matrix, and that the first player to reach a point 20 units above the square diametrically opposite to that on the board on which he or she started would be the winner.

Other variations of three dimensional movement are possible, so, for example, where there is a hexagonal games board with a matrix on it consisting of hexagons, there could be four axes of reference controlled by four backgrounds, that is, backgrounds A, B, and C would each control movement along a different axis running perpendicularly through the respective parallel edges of the hexagons, and background D would control movement along an axis running vertically upwards (or downwards) from the board the board were horizontal, and horizontally outwards (or inwards) in relation to the board if the board were vertical.

Just as diagonal movement is possible horizontally, as already described, diagonal movement is also possible upwards or downwards. The playing surface need not be flat for three dimensions movement to be possible; it could, for example, undulate, or be a cylinder, or a solid of revolution, or a sphere.

If an icosahedral dice is to be used where there are Light, Intermediate and Dark backgrounds, and if Intermediate is to be used for the vertical axis, one example of the combinations of symbols and backgrounds there could be on it is as follows:

Light *, Light +3, Light +2, Light +1, Light 0, Light −1, Light −2;

Intermediate *, Intermediate +3, Intermediate +2, Intermediate +1, Intermediate −1, Intermediate −2;

Dark *, Dark +3, Dark +2, Dark +1, Dark 0, Dark −1, Dark −2;

with * having any value from +4 to −2 inclusive, including 0 in each case, even though there is no symbol for Intermediate 0 on the dice.

Where there are several backgrounds, single tile dice can offer a full range of random symbols without the limitations imposed by the use of a single polyhedron. Another alternative would be to use two dice, one of which could be a decahedron having on it one set of the symbols *, +5, +4, +3, +2, +1, 0, −1, −2, −3, or alternatively an icosahedron having on it two sets of those symbols, in each case against a plain background, and the other dice being:

for three backgrounds, a cube having two Light faces, two Intermediate faces, and two Dark faces, but no symbols;

for four backgrounds, an octahedron having two faces each showing backgrounds A, B, C, and D respectively, but no symbols;

for five backgrounds, either a decahedron having two faces for each background, or an icosahedron having four faces for each background, but with no symbols on either;

for six backgrounds, a cube having a different background on each face, but no symbols on it.

The two dice would be used simultaneously.

Domino dice could be adapted to a situation where there are more than two sets of symbols with different backgrounds. The domino dice could show different pairings of faces, so where there are three backgrounds a full set of domino dice would contain every combination of symbols against Light and Dark backgrounds, against Light and intermediate backgrounds, and against intermediate and Dark backgrounds, with two faces appearing on each domino dice; where there are ten symbols, a full set would contain 300 domino dice. Alternatively, each domino dice could have on it three faces, being one for each of the three backgrounds, with every combination of symbols being represented in a full set; where there are ten symbols, a full set would contain 1000 domino dice. Where there are four or more backgrounds, domino dice could similarly have two or more faces with a different background on each face. Where there were three or more backgrounds, greater skill would be required to play with domino dice that would be required where there were only two backgrounds.

Whether domino dice have two faces, and two backgrounds, or a greater number of either or both, they could also be used for games where matching is required.

One or more dice could be used with or without a games board for gaming. Polyhedral dice would be particularly suitable for this purpose, especially regular icosahedral dice, since there is an equal probability of each face on such a dice being thrown. A game might provide for a player to predict additionally or alternatively to other factors the background or backgrounds to the face or faces thrown, or the number or numbers, or their total, or the polarity of that total. If more than one dice were used, they need not be identical, provided that all the players knew what symbols and backgrounds appeared on each face and provided that there was an equal probability of each face of each dice being thrown.

If two icosahedral dice are used, each of which has on it the symbols *, +5, +4, +3, +2, +1, 0, −1, −2, −3, once against a Light background, and once against a Dark background, one example of a game which could be played is as follows:

Each player tries to predict (a) the total, or polarity of the total, of the numbers which will be thrown (but not a total without its polarity); and/or (b) whether the backgrounds will be both Dark, or both Light, or both the same (whether Dark or Light), or mixed.

The star (*) is not treated as a number, and the players may not place bets on it.

With two such dice, the possible totals range between +10 and −6, and the probabilities of different totals resulting vary, and so the payoff odds would vary for different totals.

The players would place their chips on a board providing for all possible variations mentioned in (a) and (b) above, and all possible combinations thereof, and after all bets have been placed the croupier rolls each dice in turn. Since each dice has positive and negative numbers and a zero on it, the total could be greater or less or the same as that shown on the first dice, and so play would be enhanced.

A player who correctly predicts the result wins and is paid in accordance with the appropriate payoff odds.

If two stars are thrown, all chips other than those correctly and only predicting the combination of backgrounds (and therefore winning) are forfeited to the bank.

If a star and a number are thrown, all chips other than (i) those correctly and only predicting the combination of backgrounds (and therefore winning) and (ii) those correctly predicting both the combination backgrounds and either the number thrown (including its polarity) or its polarity alone are forfeited to the bank, but in case (ii) the player has the choice of either having half the value of his or her chips forfeited to the bank or of using the full value of his or her chips in the next game.

Many variations of this game are possible.

Single tile dice, and also domino dice where there are different combinations of backgrounds on different domino dice, can also be used with or without a games board for gaming purposes; this includes games where the players try to predict, whether in conjunction with other factors or not, what the background or combination of backgrounds will be on those which are drawn.

It will be appreciated that many other embodiments and many variations to the above mentioned embodiments may be made without departing from the scope of the invention. For example, the random number generator may comprise an electronic device adapted to provide an indicia for forward or rearward motion. Similarly the random number generator may comprise a "spinner" which comprises a regular polygon having a spindle passing through its centre, each edge of the polygon being representative of an indicia for forward or rearward motion. Additionally or alternatively such random number generaltors could act as random background choice of axis.

Another embodiment of a random number generator would be similar to a roulette wheel (whether manually operated or motorised) in which the symbols allocated to the various compartments in which the ball may come to rest could provide for forward and backward movement and for random choice of axis For example the symbols *, +5, +4, +3, +2, +1, −1, −2, −3 could each appear four times, once against each of four distinctive backgrounds, with O appearing in the 37th compartment against a plain background. Since O would not result in any movement, the fact that O did not have any of the four distinctive backgrounds would not matter.

I claim:

1. A game comprising: a playing surface defining a plurality of regions; at least one token capable of moving across the surface from a first region to a second region; and means for indicating at least two mutually unassociated criteria of movement including a first base vector (i) and second base vector (j), which base vectors determine the direction of movement of the token, and for indicating separate scalar values (A and B), the scalar values determining the magnitudes of first and second vectors (Ai and Bj) such that a resultant vector, indicating overall movement of the token, is determined by the sum of the two vectors Ai and Bj, said means embodying one piece for simultaneously obtaining the first and second base vectors and the separate scalar values.

2. A game according to claim 1, wherein the independent directions are perpendicular to one another, similar to the arrangement of axes on a graph whose coordinate system is determined by the Cartesian coordinate system.

3. A game according to claim 1, wherein more than one player can play at the same time and each player may have a predetermined start and end position.

4. A game according to claim 1, wherein there are at least three axes of reference.

5. A game according to claim 1, wherein the playing surface is the whole or part of the surface of a solid.

6. A game according to claim 1, wherein the playing surface, along each side, has a colored background, the color of the background controlling movement of the token along an axis.

7. A game according to claim 1, wherein the playing surface is a square board having on it four separate pairs of axes of reference, that is, one pair for each of up to four players.

8. A game according to claim 1, wherein each player may start from a different position on the playing surface and each player may have different frames of reference, that is, a positive or forward direction for one player may represent a negative or backward direction for another player.

9. A game according to claim 1, wherein the matrix or the game's board or both are pellucid, the arrangement being such that one of the matrix and game's board can be placed over the other or inserted in the other.

10. A game according to claim 1, wherein there are interchangeable sets of matrices and boards.

11. A game according to claim 1, said indicating means comprising a playing apparatus having a plurality of faces, a first set of symbols on some of the faces, and a second set of symbols on different faces, wherein the faces bear indicia providing at least a third and fourth grouping of symbols, so that the symbols, the grouping into a first or second set and the grouping into a third or fourth set respectively provide three mutually unassociated criteria of movement including direction of movement, distance of movement, and axis of reference, variations or consequences on at least some of the faces of the apparatus for moving the token across the playing surface.

12. A game according to claim 1, which is adapted to be played with a playing apparatus consisting of a plurality of tiles or tokens or cards, (not including playing cards) wherein each tile or token or card has on its single face one of a plurality of symbols, the symbols of such playing apparatus being grouped into at least two sets, so as to enable a random score to be generated according to up to three criteria including distance of movement, direction of movement and axis of reference when such a tile or token or card is selected at random.

13. A game comprising: a playing surface; a plurality of regions defining a matrix disposed on the said surface and at least one token arranged to move under the direction of a random indicator, the token being movable from a first region of the matrix to a second region of the matrix under the influence of the indicator; characterized in that the random indicator is capable of indicating at least two mutually unassociated criteria of movement including the amount of movement in at least two independent directions simultaneously, said random indicator embodying one piece which simultaneously indicates direction and amount of movement.

14. A game according to claim 13, wherein the independent directions are perpendicular to one another, similar to the arrangement of axes on a graph whose coordinate system is determined by the Cartesian coordinate system.

15. A game according to claim 13, wherein more than one player can play at the same time and each player may have a predetermined start and end position.

16. A game according to claim 13, wherein there are at least three axes of reference.

17. A game according to claim 13, wherein the playing surface is the whole or part of the surface of a solid.

18. A game according to claim 13, wherein the playing surface, along each side, has a colored background, the color of the background controlling movement of the token along an axis.

19. A game according to claim 13, wherein the playing surface is a square board having on it four separate pairs of axes of reference, that is, one pair for each of up to four players.

20. A game according to claim 13, wherein each player may start from a different position on the playing surface and each player may have different frames of reference, that is, a positive or forward direction for one player may represent a negative or backward direction for another player.

21. A game according to claim 13, wherein the matrix or the game's board or both are pellucid, the arrangement being such that one of the matrix and game's board can be placed over the other or inserted in the other.

22. A game according to claim 13, wherein there are interchangeable sets of matrices and boards.

23. A game according to claim 13, said random indicator having a plurality of faces, a first set of symbols on some of the faces, and a second set of symbols on different faces, wherein the faces bear indicia providing at least a third and fourth grouping of symbols, so that the symbols, the grouping into a first or second set and the grouping into a third or fourth set respectively provide three mutually unassociated criteria of movement including direction of movement distance of movement, and axis of reference, variations or consequences on at least some of the faces of the apparatus for moving the token across the playing surface.

24. A game according to claim 13, which is adapted to be played with a playing apparatus consisting of a plurality of tiles or tokens or cards, (not including playing cards) wherein each tile or token or card has on its single face one of a plurality of symbols, the symbols of such playing apparatus being grouped into at least two sets, so as to enable a random score to be generated according to up to three criteria including distance of movement, direction of movement and axis of reference when such a tile or token or card is selected at random.

25. A game comprising: a playing surface defining a plurality of regions; at least one token capable of moving across the surface from a first region to a second region; and means for indicating a first base vector (i) and second base vector (j), which base vectors determine the direction of movement of the token, and for indicating separate scalar values (A and B), the scalar values determining the magnitudes of first and second vectors (Ai and Bj) such that a resultant vector, indicating overall movement of the token, is determined by the sum of the two vectors Ai and Bj, said means embodying one piece for simultaneously obtaining the first and second base vectors and the separate scalar values, wherein the playing surface, along each side, has a colored background, the color of the background controlling movement of the token along an axis.

26. A game comprising: a playing surface; a plurality of regions defining a matrix disposed on the said surface and at least one token arranged to move under the direction of a random indicator, the token being movable from a first region of the matrix to a second region of the matrix under the influence of the indicator; characterized in that the random indicator is capable of indicating the amount of movement in at least two independent directions simultaneously, said random indicator embodying one piece which simultaneously indicates direction and amount of movement, wherein the playing surface, along each side, has a colored background, the color of the background controlling movement of the token along an axis.

27. A game comprising: a playing surface defining a plurality of regions; at least one token capable of moving across the surface from a first region to a second region; and means for indicating three criteria of movement including a first base vector (i) and second base vector (j), which base vectors determine the direction of movement of the token, and for indicating separate scalar values (A and B), the scalar values determining the magnitudes of first and second vectors (Ai and Bj) such that a resultant vector, indicating overall movement of the token, is determined by the sum of the two vectors Ai and Bj, said means embodying one piece for simultaneously obtaining the first and second base vectors and the separate scalar values, said indicating means comprising a playing apparatus having a plurality of faces, a first set of symbols on some of the faces, and a second set of symbols on different faces, wherein the faces bear indicia providing at least a third and fourth grouping of symbols, so that the symbols, the grouping into a first or second set and the grouping into a third or fourth set respectively provide three mutually unassociated criteria of movement, variations or consequences on at least some of the faces of the apparatus for moving the token across the playing surface.

28. A game comprising: a playing surface; a plurality of regions defining a matrix disposed on the said surface and at least one token arranged to move under the direction of a random indicator, the token being movable from a first region of the matrix to a second region of the matrix under the influence of the indicator; characterized in that the random indicator is capable of indicating three criteria of movement including the amount of movement in at least two independent directions simultaneously, said random indicator embodying one piece which simultaneously indicates direction and amount of movement, said random indicator having a plurality of faces, a first set of symbols on some of the faces, and a second set of symbols on different faces, wherein the faces bear indicia providing at least a third and fourth grouping of symbols, so that the symbols, the grouping into a first or second set and the grouping into a third or fourth set respectively provide three mutually unassociated criteria of movement, variations or consequences on at least some of the faces of the apparatus for moving the token across the playing surface.

29. A game comprising: a playing surface defining a plurality of regions; at least one token capable of moving across the surface from a first region to a second region; and means for indicating three criteria of movement including a first base vector (i) and second base vector (i), which base vectors determine the direction of movement of the token, and for indicating separate scalar values (A and B), the scalar values determining the magnitudes of first and second vectors (Ai and Bj) such that a resultant vector, indicating overall movement of the token, is determined by the sum of the two vectors Ai and Bj, said means embodying one piece for simultaneously obtaining the first and second base vectors and the separate scalar values, said game being adapted to be played with a playing apparatus consisting of a plurality of tiles or tokens or cards, wherein each tile or token or card has on its single face one of a plurality of symbols, the symbols of such playing apparatus being grouped into at least two sets, so as to enable a random score to be generated according up to three criteria including distance of movement, direction of movement and axis of reference when such a tile or token or card is selected at random.

30. A game comprising: a playing surface; a plurality of regions defining a matrix disposed on the said surface and at least one token arranged to move under the direction of a random indicator, the token being movable from a first region of the matrix to a second region of the matrix under the influence of the indicator; characterized in that the random indicator is capable of indicating three criteria of movement including the amount of movement in at least two independent directions simultaneously, said random indicator embodying one piece which simultaneously indicates direction and amount of movement, said game being adapted to be played with a playing apparatus consisting of a plurality of tiles or tokens or cards, wherein each tile or token or card has on its single face one of a plurality of symbols, the symbols of such playing apparatus being grouped into at least two sets, so as to enable a random score to be generated according up to three criteria including distance of movement, direction of movement, and axis of reference when such a tile or token or card is selected at random.

* * * * *